US011608695B2

(12) United States Patent
Steffenhagen et al.

(10) Patent No.: US 11,608,695 B2
(45) Date of Patent: Mar. 21, 2023

(54) INJECTOR REMOTE TUBING GUIDE ALIGNMENT DEVICE

(71) Applicant: NOV INTERVENTION AND STIMULATION EQUIPMENT US, LLC, Houston, TX (US)

(72) Inventors: Timothy Scott Steffenhagen, Fort Worth, TX (US); Mike Xiaolei Lu, Arlington, TX (US); Matthew Stephen Lane, Fort Worth, TX (US)

(73) Assignee: NOV INTERVENTION AND STIMULATION EQUIPMENT US, LLC, Houston, TX (US)

( * ) Notice: Subject to any disclaimer, the term of this patent is extended or adjusted under 35 U.S.C. 154(b) by 0 days.

(21) Appl. No.: 17/250,799

(22) PCT Filed: Sep. 17, 2019

(86) PCT No.: PCT/US2019/051443
§ 371 (c)(1),
(2) Date: Mar. 4, 2021

(87) PCT Pub. No.: WO2020/060998
PCT Pub. Date: Mar. 26, 2020

(65) Prior Publication Data

US 2021/0207445 A1 Jul. 8, 2021

Related U.S. Application Data

(60) Provisional application No. 62/732,292, filed on Sep. 17, 2018.

(51) Int. Cl.

| | |
|---|---|
| ***E21B 19/22*** | (2006.01) |
| ***E21B 19/08*** | (2006.01) |
| ***E21B 17/20*** | (2006.01) |

(52) U.S. Cl.
CPC ..... *E21B 19/22* (2013.01); *E21B 17/20* (2013.01)

(58) Field of Classification Search
CPC ..... E21B 19/22; E21B 19/08
See application file for complete search history.

(56) References Cited

U.S. PATENT DOCUMENTS 4,585,061 A 4/1986 Lyons, Jr. et al.
5,029,642 A * 7/1991 Crawford ..... E21B 31/113 166/77.2

(Continued)

FOREIGN PATENT DOCUMENTS

CA 3017404 A1 3/2019
GB 2229208 A 9/1990

(Continued)

OTHER PUBLICATIONS

"European Application Serial No. 19836388.9, Communication Pursuant to Article 94(3) EPC dated Jan. 18, 2022", 4 pgs.

(Continued)

*Primary Examiner* — Giovanna Wright
(74) *Attorney, Agent, or Firm* — Schwegman Lundberg & Woessner, P.A.

(57) ABSTRACT

A coiled tubing injector system may include a coiled tubing injector guide configured for guiding coiled tubing into a coiled tubing injector and a remotely adjustable guide mechanism. The remotely adjustable guide mechanism may include a guide mount configured for adjustably securing the coiled tubing injector guide to a frame of the coiled tubing injector and a drive mechanism configured for remotely adjusting a position of the guide mount relative to the frame.

27 Claims, 21 Drawing Sheets

(56) References Cited

U.S. PATENT DOCUMENTS

| | | | | |
|---|---|---|---|---|
| 5,799,731 | A | 9/1998 | Avakov et al. | |
| 5,845,708 | A * | 12/1998 | Burge | E21B 15/00 166/77.3 |
| 6,158,516 | A * | 12/2000 | Smith | E21B 19/22 175/89 |
| 6,216,780 | B1 | 4/2001 | Goode et al. | |
| 6,681,614 | B1 | 1/2004 | Riffe | |
| 7,036,578 | B2 | 5/2006 | Austbo et al. | |
| 7,708,058 | B1 * | 5/2010 | Gipson | E21B 19/22 166/77.2 |
| 9,464,493 | B2 | 10/2016 | Andreychuk et al. | |
| 10,975,634 | B2 | 4/2021 | Doran et al. | |
| 2003/0209346 | A1 | 11/2003 | Austbo et al. | |
| 2004/0211555 | A1 | 10/2004 | Austbo et al. | |
| 2006/0096754 | A1 | 5/2006 | Weightmann | |
| 2006/0163415 | A1 | 7/2006 | Geddes et al. | |
| 2008/0173480 | A1 | 7/2008 | Annaiyappa et al. | |
| 2008/0314580 | A1 * | 12/2008 | Wood | E21B 7/02 166/77.2 |
| 2012/0085531 | A1 * | 4/2012 | Leising | E21B 47/00 166/77.2 |
| 2013/0048270 | A1 | 2/2013 | Havinga et al. | |
| 2014/0000867 | A1 | 1/2014 | Andreychuk et al. | |
| 2014/0174194 | A1 | 6/2014 | Wu | |
| 2015/0101799 | A1 | 4/2015 | Steffenhagen et al. | |
| 2015/0144357 | A1 * | 5/2015 | Hampson | E21B 19/22 166/381 |
| 2016/0138347 | A1 | 5/2016 | Bjornenak | |
| 2016/0369614 | A1 | 12/2016 | Turner et al. | |
| 2017/0006878 | A1 | 1/2017 | Domenicucci et al. | |
| 2017/0260835 | A1 | 9/2017 | Crawford et al. | |
| 2018/0320502 | A1 | 11/2018 | Turner et al. | |
| 2019/0062068 | A1 | 2/2019 | Kreisfeld et al. | |
| 2019/0085646 | A1 | 3/2019 | Doran et al. | |
| 2021/0348459 | A1 | 11/2021 | Steffenhagen et al. | |

FOREIGN PATENT DOCUMENTS

| | | | |
|---|---|---|---|
| GB | 2568154 | A | 5/2019 |
| SG | 10201808078 | | 4/2019 |
| WO | WO-2009044117 | A1 | 4/2009 |
| WO | WO-2015076775 | A1 | 5/2015 |
| WO | WO-2017105411 | A1 | 6/2017 |
| WO | WO-2020060998 | A1 | 3/2020 |
| WO | WO-2020131621 | A1 | 6/2020 |
| WO | WO-2020223502 | A1 | 11/2020 |

OTHER PUBLICATIONS

"U.S. Appl. No. 17/309,767, Response filed Jan. 20, 2022 to Non Final Office Action dated Oct. 22, 2021", 7 pgs.
"U.S. Appl. No. 17/309,767, Notice of Allowance dated Feb. 16, 2022", 5 pgs.
"European Application Serial No. 19836388.9, Response filed Feb. 14, 2022 to Communication Pursuant to Article 94(3) EPC dated Jan. 18, 2022", 13 pgs.
"U.S. Appl. No. 16/131,291, Examiner Interview Summary dated Sep. 28, 2020", 3 pgs.
"U.S. Appl. No. 16/131,291, Final Office Action dated Aug. 10, 2020", 9 pgs.
"U.S. Appl. No. 16/131,291, Non Final Office Action dated Apr. 6, 2020", 11 pgs.
"U.S. Appl. No. 16/131,291, Notice of Allowance dated Dec. 14, 2020", 6 pgs.
"U.S. Appl. No. 16/131,291, Response filed Jul. 6, 2020 to Non Final Office Action ated Apr. 6, 2020", 10 pgs.
"U.S. Appl. No. 16/131,291, Response filed Nov. 9, 2020 to Final Office Action dated Aug. 10, 2020", 7 pgs.
"International Application Serial No. PCT/US2019/051443, International Search Report dated Nov. 13, 2019", 2 pgs.
"International Application Serial No. PCT/US2019/051443, Written Opinion dated Nov. 13, 2019", 5 pgs.
"International Application Serial No. PCT/US2019/066238, International Search Report dated Mar. 25, 2020", 5 pgs.
"International Application Serial No. PCT/US2019/066238, Written Opinion dated Mar. 25, 2020", 5 pgs.
"International Application Serial No. PCT/US2020/030755, International Search Report dated Aug. 4, 2020", 2 pgs.
"International Application Serial No. PCT/US2020/030755, Written Opinion dated Aug. 4, 2020", 7 pgs.
"United Kingdom Application Serial No. 1815273.6, Response filed Sep. 17, 2019 to Search Report dated Feb. 28, 2019", 21 pgs.
"United Kingdom Application Serial No. 1815273.6, Search Report dated Feb. 28, 2019", 6 pgs.
"International Application Serial No. PCT/US2019/051443, International Preliminary Report on Patentability dated Mar. 25, 2021", 7 pgs.
"International Application Serial No. PCT/US2020/030755, International Preliminary Report on Patentability dated May 18, 2021", 8 pgs.
"International Application Serial No. PCT/US2019/066238, International Preliminary Report on Patentability dated Jul. 1, 2021", 7 pgs.
"U.S. Appl. No. 17/309,767, Non-Final Office Action dated Oct. 22, 2021", 5 pgs.
"European Application Serial No. 19863465.1, Extended European Search Report dated Apr. 19, 2022", 8 pgs.
"Saudi Arabia Application No. 521421468, Office Action dated Aug. 31, 2022", w English translation, 13 pgs.
"European Application Serial No. 19863465.1, Response filed Nov. 2, 2022 to Extended European Search Report dated Apr. 19, 2022", 13 pgs.
U.S. Appl. No. 17/594,823, filed Oct. 29, 2021, Chain Wear Sensor.
U.S. Appl. No. 16/131,291, filed Sep. 14, 2018, Tubing Guide Stabilization.
U.S. Pat. No. 10,975,634, filed Jun. 17, 2021, Coiled Tubing Injector With Gripper Shoe Carrier Position Monitor.
U.S. Appl. No. 17/309,767.
U.S. Pat. No. 11,359,446.

* cited by examiner

INJECTOR REMOTE TUBING GUIDE ALIGNMENT DEVICE

CROSS-REFERENCE TO RELATED APPLICATIONS

The present application is a U.S. National Stage Filing under 35 U.S.C. 371 from International Application No. PCT/US2019/051443, filed Sep. 17, 2019, which claims priority to U.S. Provisional Application 62/732,292 filed on Sep. 17, 2018 and entitled Injector Remote Tubing Guide Alignment Device, the content of each for which are hereby incorporated by reference in their entirety.

FIELD OF THE INVENTION

The present disclosure relates to coiled tubing units. More particularly, the present disclosure relates to coiled tubing injector guides for directing tubing into coiled tubing injectors. Still more particularly, the present disclosure relates to devices, systems, and methods for aligning coiled tubing injector guides and doing so remotely to avoid otherwise dangerous and cumbersome adjustments.

BACKGROUND OF THE INVENTION

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Coiled tubing refers to a continuous string of pipe coiled on a take-up reel for transportation and handling. Coiled tubing is provided with outer diameters ranging from 0.75 inches to 4 inches and may be used in a wide range of oilfield services and operations throughout the life of a well. A coiled tubing unit may be a mobile or stationary vehicle or structure for performing coiled tubing operations at a well. A coiled tubing unit may often have a coiled tubing injector. The injector may drive or guide the tubing into a well for performing various oilfield services or operations. The coiled tubing unit may additionally have a coiled tubing guide, which may generally direct the tubing, as it is unspooled from a reel, into the injector. In general, the guide may help to mitigate bends or kinks in the continuous tubing before it is fed into the injector and may be used to control alignment of the tubing as it enters the injector.

From time to time, such as during set up or during operations, the alignment of the tubing guide may be adjusted. Current systems, as shown in FIGS. 4 and 5, for example, include a threaded alignment shaft and a guide mount that is movable along the shaft. The guide mount may include a collar that is moveable along the shaft and large threaded nuts may be positioned on the shaft on either side of the collar. The nuts may be turned on the shaft causing them to travel along the shaft thereby adjusting the position of the collar along the shaft and thereby controlling the position of the guide mount. A locking nut may also be provided to secure the position once the mount is adjusted.

Adjusting the above-described mechanism may be done manually to align the tubing guide with the injector. This alignment may be helpful to properly align the entering tubing with the injector chains. This manual adjustment may be done on the ground (i.e., during set up) or in a man lift basket. In the latter case, the lift basket may be 20-100 ft above the ground and an operator may use an extremely large wrench or wrenches to turn the nuts. Due to the difficulty in making these adjustments and/or due to the time required, the adjustment is often not performed or may only be performed at initial set up. This can cause issues to the machine or the tubing because the guide may not be in proper alignment with the injector causing the tubing to enter the injector out of alignment. This can lead to incorrect injector load readings and/or excess wear on, or damage to, drive bearings, traction cylinders, bushings, chains, and/or other components of the injector. In some cases, this can lead to damage to the tubing itself directly or from continued operation of the injector with damaged or failed chain components, inserts, or other components. Damage to the tubing can shorten its life, in some cases can render the tubing inoperable, and may cause potentially unsafe operating conditions. If one or more components of a tubing injector fails, the tubing may need to be cut and/or removed from the well. In some cases, this can lead to relatively high costs in both time and money because of the costs to repair components, but also because well operations may be stalled while components are repaired or replaced.

SUMMARY

The following presents a simplified summary of one or more embodiments of the present disclosure in order to provide a basic understanding of such embodiments. This summary is not an extensive overview of all contemplated embodiments, and is intended to neither identify key or critical elements of all embodiments, nor delineate the scope of any or all embodiments.

In one or more embodiments, a coiled tubing injector system may include a coiled tubing injector guide configured for guiding coiled tubing into a coiled tubing injector and a remotely adjustable guide mechanism. The remotely adjustable guide mechanism may include a guide mount configured for adjustably securing the coiled tubing injector guide to a frame of the coiled tubing injector and a drive mechanism configured for remotely adjusting a position of the guide mount relative to the frame.

In one or more embodiments, a method of adjusting a guide mount of a coiled tubing injector guide on a coiled tubing injector may be provided. The method may include receiving a coiled tubing position from an operator. The method may also include sensing a position of at least one of the guide mount and coiled tubing passing through the injector. The method may also include adjusting the position of the guide mount to an aligned position to provide the coiled tubing position.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

The present disclosure relates to novel and advantageous devices, systems, and methods for remotely adjusting a coiled tubing guide extending from a coiled tubing injector. In one or more embodiments, the tubing guide may be operably connected to a drive mechanism that may remotely and controllably cause the tubing guide mount to translate across the top of a coiled tubing injector frame. The drive mechanism may be configured for precise controlled movement of the tubing guide mount so as to allow for precise alignment of the coiled tubing with the tubing injector. The system may also be configured to maintain its position once aligned to avoid inadvertent movement leading to further misalignment. The system may be advantageous particularly due to its ability to be adjusted remotely thereby avoiding the need for manual adjustment and exposure of personnel to dangerous elevated conditions. The system may be further advantageous due to is high level of precision under significant loading as well as its ability to maintain its position once aligned.

Figure 1:
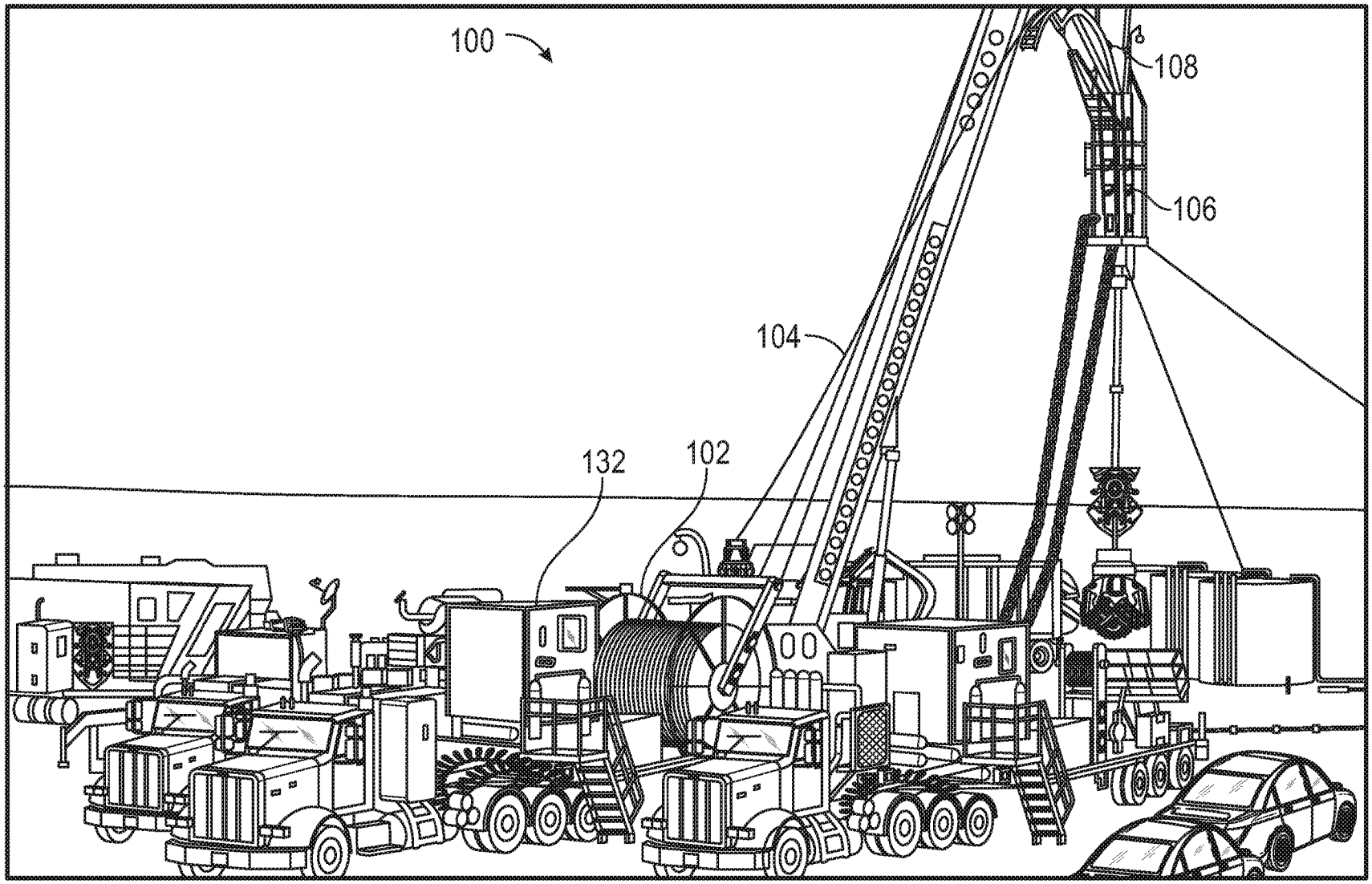
FIG. 1 is a perspective view of a coiled tubing unit in place on a well pad, according to one or more embodiments.

As shown in FIG. 1, a coiled tubing unit 100 may include a tubing spool 102 containing a very high linear footage of coiled tubing 104. The unit 100 may also include a coiled tubing injector 106 for advancing the tubing into a well and a coiled tubing guide 108 for guiding the tubing from the spool and into the injector 106. In one or more embodiments, the injector 106 and the guide 108 may be supported by a crane and suspended above a well allowing the injector 106 to pull the tubing 104 from the spool 102 and through the guide 108 and advance the tubing 104 into the well.

Figure 2:
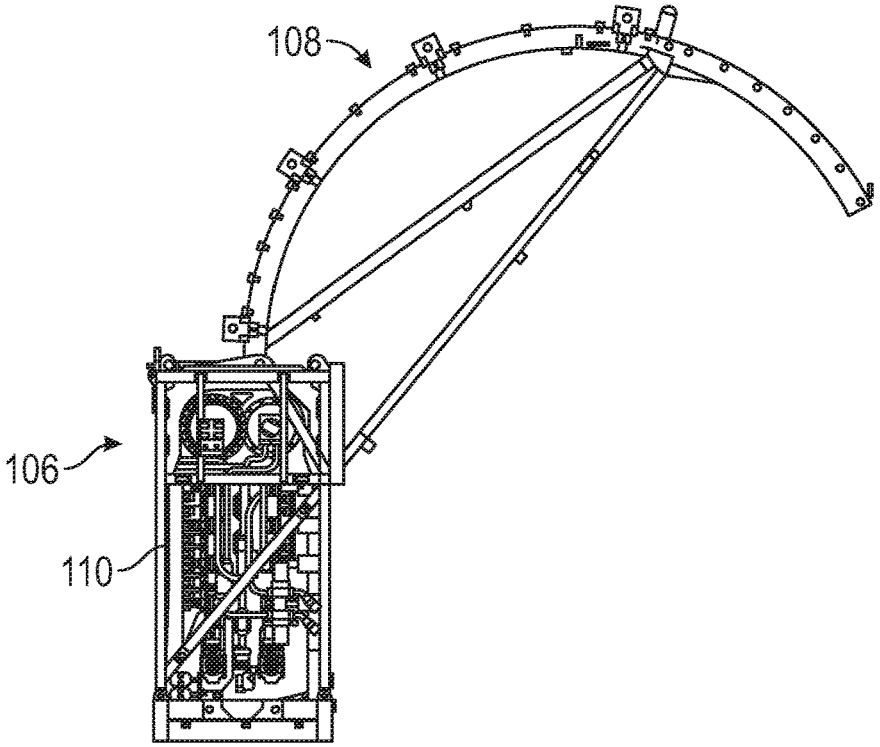
FIG. 2 is a side view of a coiled tubing guide coupled to a coiled tubing injector frame, according to one or more embodiments.

FIG. 2 is a side view of a tubing guide 108 in position on a tubing injector 106. As shown, the tubing guide 108 may be an arcuate structure configured for guiding the tubing 104 off of the spool 102 and into the injector 106. The injector 106 may be arranged within a frame 110 and the tubing guide 108 may be mounted on the frame. As show in a closer view in FIG. 3, the tubing guide 108 may be secured to the frame of the injector so as to align the incoming tubing 104 with the injector 106 allowing the injector chains or other traction device to engage and advance the tubing.

Figure 3:
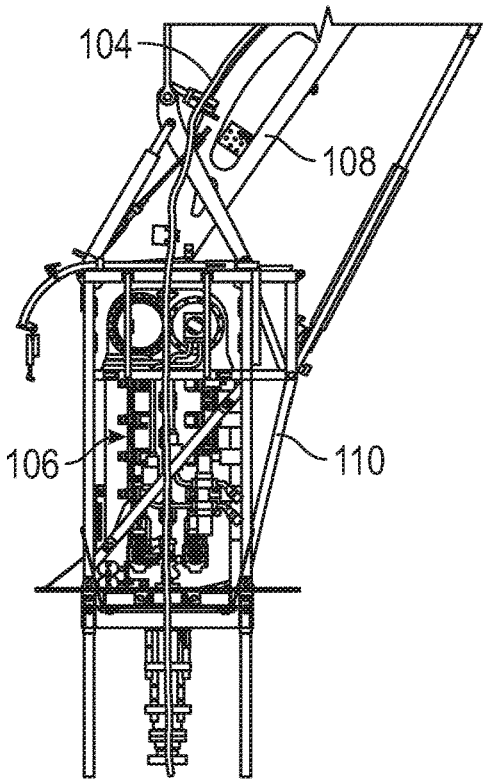
FIG. 3 is a close-up side view of a connection point between a coiled tubing guide and an injector, according to one or more embodiments.
Figure 4:
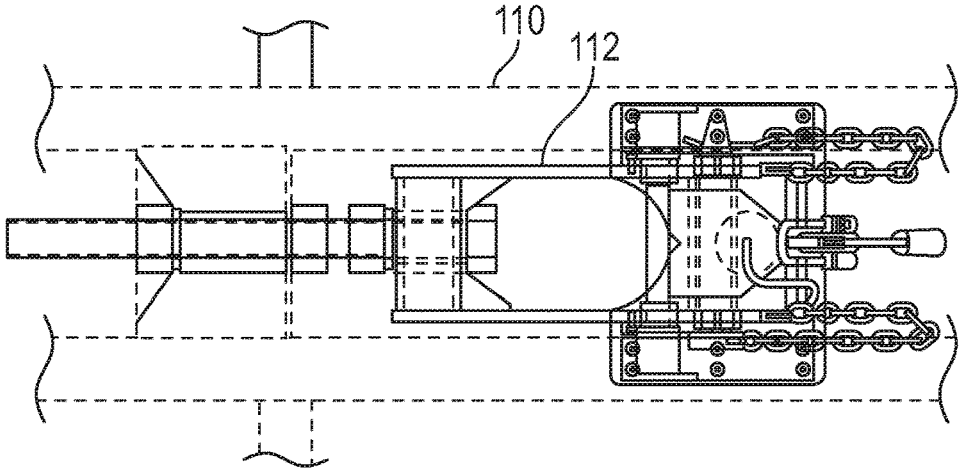
FIG. 4 is atop view of a guide mount on a frame of a coiled tubing injector, according to one or more embodiments.
Figure 5:
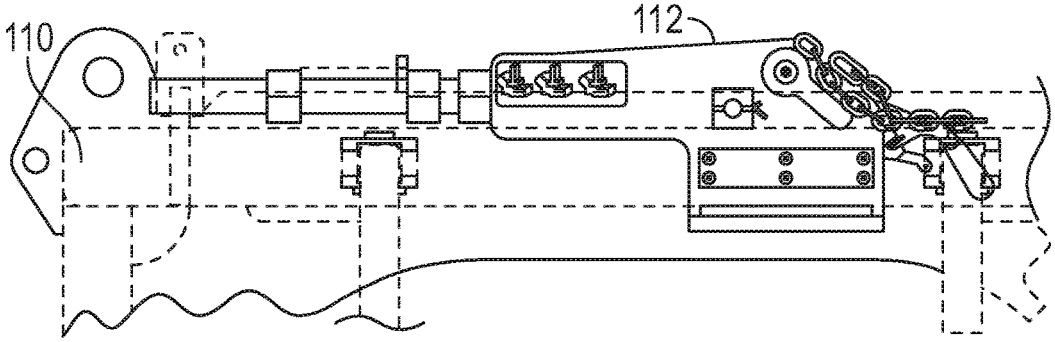
FIG. 5 is aside view thereof, according to one or more embodiments.

FIGS. 4 and 5 are top and side views, respectively, of the highlighted rectangular area of FIG. 3. As shown, a tubing guide mount 112 may be arranged on the top of injector frame 110 and may be configured to slidably translate from side to side as shown in FIG. 5. As discussed above, a threaded rod may extend through a collar on the rear portion of the mount 112 and the mount 112 and adjustment nuts may be used to control the position of the collar along the rod thereby controlling the position of the mount 112.

Figure 6:
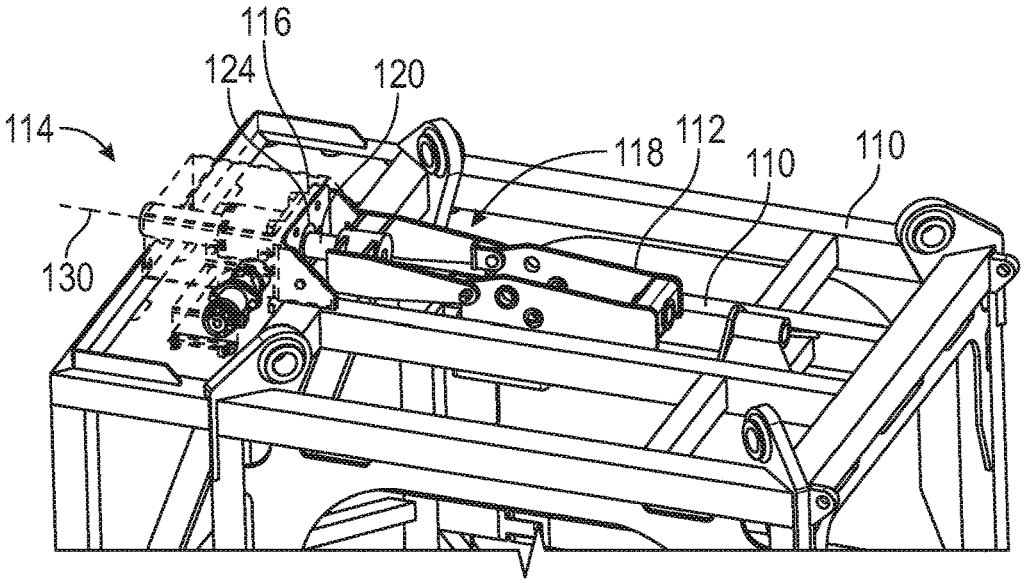
FIG. 6 is a perspective view of a remotely adjustable guide mount, according to one or more embodiments.

Turning now to FIG. 6, a portion of a remotely adjustable tubing guide 108 is shown. While not show in FIG. 6, the remotely adjustable tubing guide 108 may include a guide frame as depicted in FIGS. 2 and 3. The guide frame may be pivotally secured to a tubing guide mount 112 and the tubing guide mount 112 may be slidingly positioned on a frame 110 of a tubing injector 106. As shown, the remotely adjustable tubing guide 108 may include a drive mechanism 114 for operably adjusting the tubing guide mount 112 and, thus, the position of the tubing guide frame. The remotely adjustable tubing guide may include the mentioned drive mechanism 114, a drive mount 116, and an interface bracket 118. The drive mechanism 114 may remotely and operably adjust the position of the interface bracket 118 relative to the drive mount 116 to adjust the position of the tubing guide 108.

Figure 7:
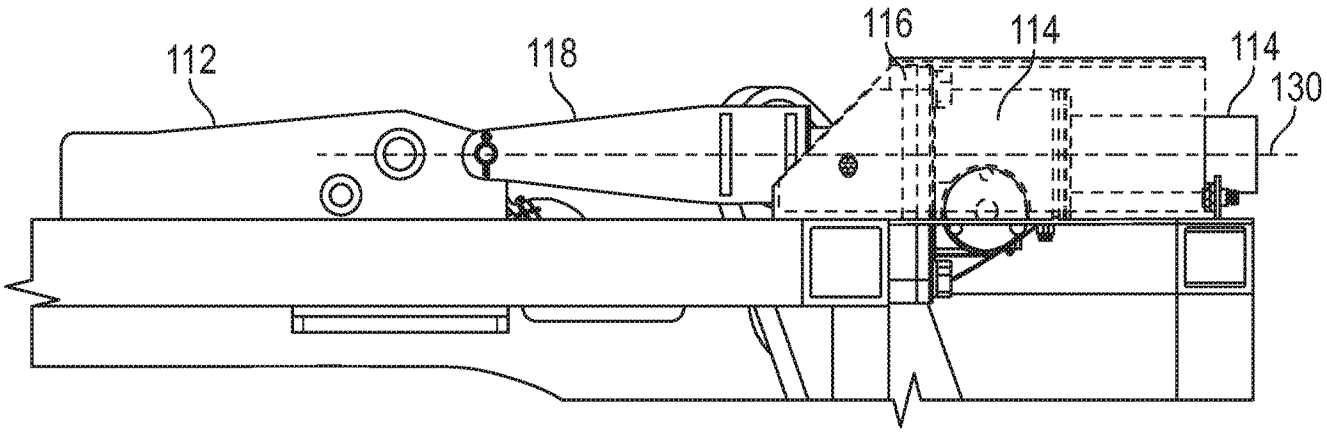
FIG. 7 is a side view thereof.
Figure 8:
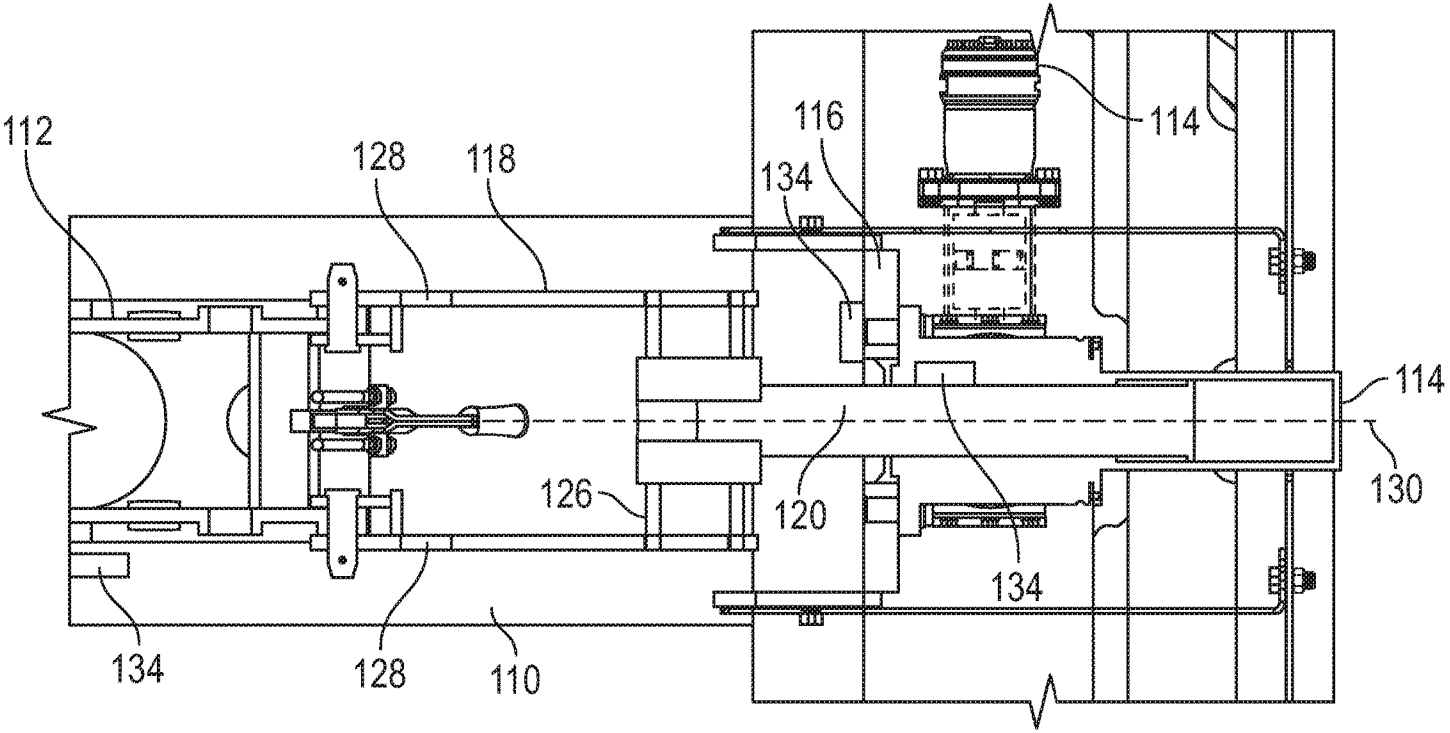
FIG. 8 is atop view thereof.
Figure 10:
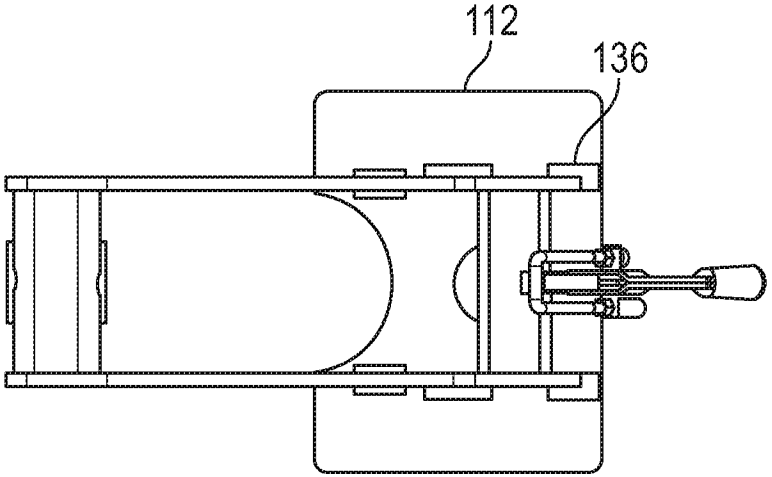
FIG. 10 is a top view of a tubing guide mount adapted for use with a remotely controlled driving mechanism, according to one or more embodiments.
Figure 35:
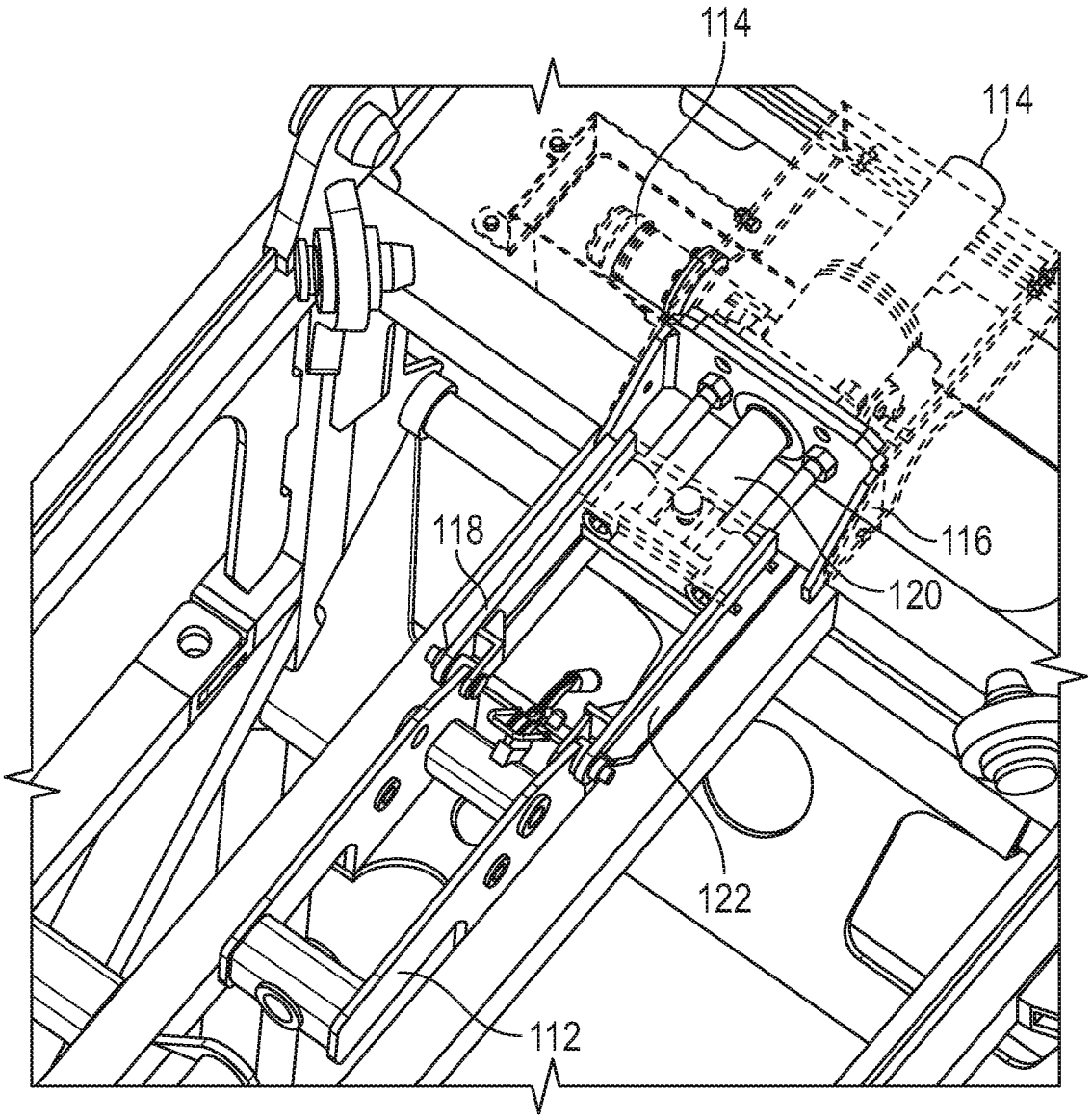
FIG. 35 includes a perspective view of still another option for a remotely adjustable guide mount, according to one or more embodiments.

As shown in FIGS. 6-8, the drive mechanism 114 may be mounted to the drive mount 116 and may be configured for engagement with and adjustment of the interface bracket 118. In one or more embodiments, the drive mechanism 114 may include an articulating element 120 such as an articulating and/or telescoping shaft. The drive mechanism 114 may cause the articulating element to advance or retract allowing for adjustment of the position of the interface bracket 118 and, thus, the guide mount 112. The drive mechanism 114 may include an electrically, pneumatically, hydraulically, or mechanically driven machine. In one or more embodiments, as shown, the drive mechanism 114 may include a worm gear drive allowing for high levels of precision adjustment and an inherent or integrated locking mechanism for maintaining the position of the mount 112 when stopped. For example, the worm gear may include a helical gear or worm wheel driven by a motor. An articulating element 120 in the form of a worm shaft may be arranged along a longitudinal axis generally tangential to and in plane with the worm wheel and may include a worm for engaging the helical gear. In one or more embodiments, the worm shaft may include a rotation resisting feature. For example, a key or keyway may be provided for rotationally engaging a keyway or key, respectively, on a fixed element. The key/keyway system may resist rotation of the worm shaft about the axis. As such, rotation of the helical gear may drive the worm shaft tangentially to the helical gear and along the longitudinal axis rather than causing the worm shaft to rotate. In one or more embodiments, the rotation resisting feature may be provided internally to the worm gear. In other embodiments, as shown in FIG. 35, the rotation resisting feature may be provided external to the worm gear and may be in the form of a brace, guide, or arm 122 on the interface bracket. That is, as shown, the interface bracket may include a horizontally extending tab, shoulder, or other frame engaging element. The frame engaging element may prevent and/or inhibit rotation of the interface bracket relative to the frame, but may allow the interface bracket to articulate horizontally along the frame and along the longitudinal axis of the articulating element. In one or more embodiments, while not shown, a bottom and a top tab may be provided to engage both a top surface of a frame element and a bottom surface of a frame element. Still other approaches to providing rotational resistance may be provided.

Turning back to FIGS. 6-8, the drive mount 116 may be configured for securing the position of the drive mechanism 114 and providing a secure stationary reference position. The drive mount 116 may be positioned on and secured to the injector frame. In one or more embodiments, the drive mount may be secured on a front side of the injector frame as opposed to the rear side. The drive mechanism 114 may cause the guide mount 112 to translate toward and/or away from the drive mount 116. In one or more embodiments, the drive mount 116 may include a face plate extending generally vertically from the injector frame. The plate may be welded, bolted, or otherwise securely fastened to the frame. In one or more embodiments, the drive mount 116 may include brace plates on either side of the face plate to manage lateral loading on the face plate. In one or more embodiments, the drive mount 116 and, for example, the face plate, may include an opening 124 for allowing the articulating element 120 to extend through the drive mount 116 and articulate back and forth through the opening 124.

The interface bracket 118 may be configured for establishing an interface between the drive mechanism 114 and the guide mount 112. The interface bracket 118 may be configured for securing to the drive mechanism 114 at one end and for securing to the guide mount 112 at an opposite end. As shown in FIGS. 8-12, the tubing guide may include a stabilization mechanism arranged at or near a pivot pin where the guide frame is secured to the guide mount. The stabilization mechanism may be the same or similar to the mechanism of U.S. Provisional Application No. 62/560,439 entitled Tubing Guide Stabilization Mechanism, the content of which is hereby incorporated by reference herein in its entirety. The interface bracket 118 may be configured to avoid interference with the stabilization mechanism while it translates with the guide mount 112. In one or more embodiments, the interface bracket 118 may include a laterally extending beam 126 and a pair of longitudinally extending struts or arms 128. The laterally extending beam 126 may be secured to and extend laterally from the articulating element 120 of the drive mechanism 114. The beam 126 may be pivotally secured to the articulating element 120 so as to allow the beam 126 to rotate about the longitudinal axis 130 or a key/keyway connection may be provided to resist relative rotation of the beam 126 and remaining portions of the interface bracket 118 about the longitudinal axis 130. However, the beam 126 may receive the articulating element 120 in a bore having a length along the longitudinal axis 130 sufficient to resist out of plane bending or rotation of the interface bracket 118 relative to the articulating element 120. The struts or arms 128 may extend longitudinally away from the beam 126 to the guide mount 112. The struts or arms 128 may be welded to the beam forming a unitary interface bracket 118. In other embodiments, the struts may be bolted or otherwise secured to the beam. The struts 128 may be arranged on either side of the stabilization mechanism maintaining clearance around the stabilization mechanism and engaging the guide mount 112. The struts or arms may each engage the guide mount and be secured thereto with a pin, a bolt, a welded connection, or another connection suitable to carry the loads from the drive mechanism and/or from the tubing guide 108. It is to be appreciated that the present remotely adjustable mechanism is configured for retrofitting known or existing tubing guides by engaging the existing guide mounts or by replacing the guide mount on the existing systems with a slightly modified guide.

Figure 9:
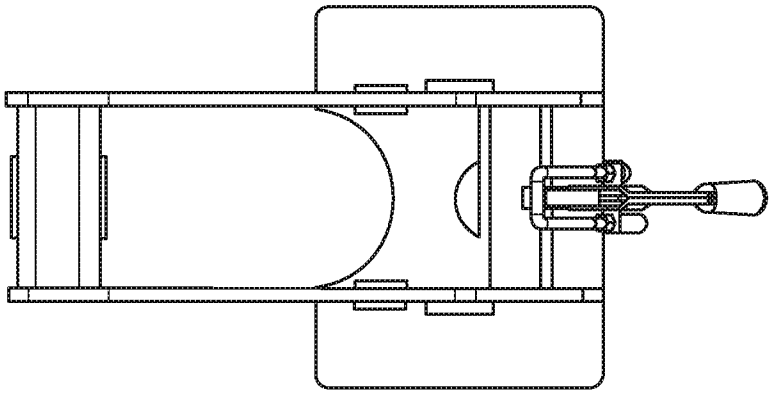
FIG. 9 is a top view of a tubing guide mount such as the mount used with the system of FIGS. 4 and 5.

In one or more embodiments, the guide mount 112 may be modified from a conventional guide mount by including attachment features for securing the interfacing bracket to the guide mount 112. As shown in FIG. 9, a conventional guide mount is shown. In comparison, FIG. 10 includes an attachment feature 136 for engaging the interfacing bracket and allowing for positional control of the guide mount.

Figure 12:
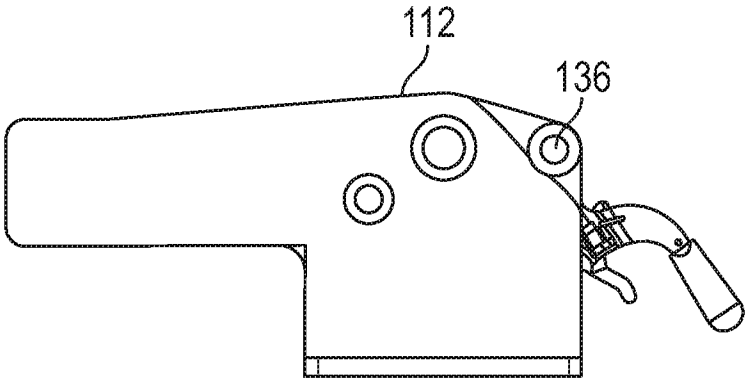
FIG. 12 is a side view of the mount of FIG. 10, according to one or more embodiments.
Figure 11:
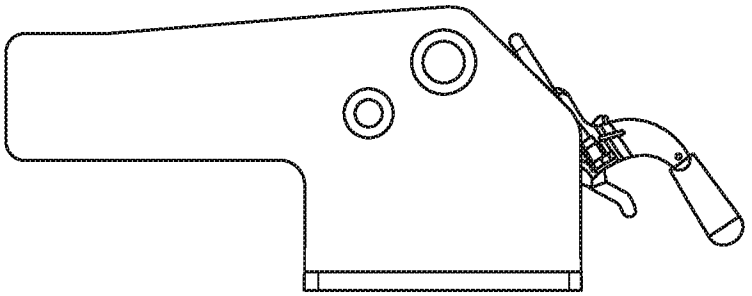
FIG. 11 is a side view of the mount of FIG. 9, according to one or more embodiments.

Similarly, FIG. 11 shows a conventional guide mount and FIG. 12, shows a guide mount with an attachment feature 136.

In one or more embodiments, the drive mechanism 114 may include wired or wireless communications systems in communication with a controller 132 for controlling the position of the guide mount 112. These systems may allow the drive mechanism to be actuated and controlled from a remote location. In addition, sensors 134 may be provided for sensing the position of the tubing guide mount relative to the frame and/or for sensing the position of the tubing entering the injector 106. The sensor or sensors 134 may be in wired or wireless communication with a display which may depict the position of the tubing 104, the relative position of the guide mount 112 and the frame or other absolute or relative positions. The user may rely on the absolute or relative positions of the elements to drive the drive mechanism and adjust the position of the guide mount so as to cause alignment of the coiled tubing with the tubing injector.

The controller 132 may include a computer readable storage medium, a processor, and one or more input and output features. The controller 132 may include software, drivers, or other software stored on the computer readable storage medium for controlling the drive mechanism. The controller may also include control software adapted to select the position of the guide mount and/or the coiled tubing and instruct the drive mechanism to move the guide mount and the coiled tubing to a selected location. In one or more embodiments, the selected location may be an aligned location where the coiled tubing is substantially center between traction units within the injector. The controller may, for example, include an input for an absolute or relative position of the coiled tubing and may have or include a stored relative dimension relating the position of the tubing to the position of the guide mount. As such, the controller may be able to adjust the guide mount to a position in order to locate the tubing at a desired location.

The sensors 134 may include visual sensors, position sensors, load sensors, motor feedback devices, or other sensors. The sensors may be adapted to sense the position of the coiled tubing passing through the injector and may be adapted to sense the position of the guide mount on the frame of the injector. It is to be appreciate that the positive mechanical connection between the drive mechanism and the guide mount may allow for reliance on motor feedback sensors to adjust the positions based on the assumption that a particular travel of the motor may cause a corresponding travel of the guide mount. Accordingly, the sensors may provide feedback to the user allowing for the system to be constantly calibrated to verify and control the stored relative position of the tubing and the guide mount. Still further, the sensors may provide continual, periodic, or selected feedback of the position of the coiled tubing passing through the injector.

Figure 36:
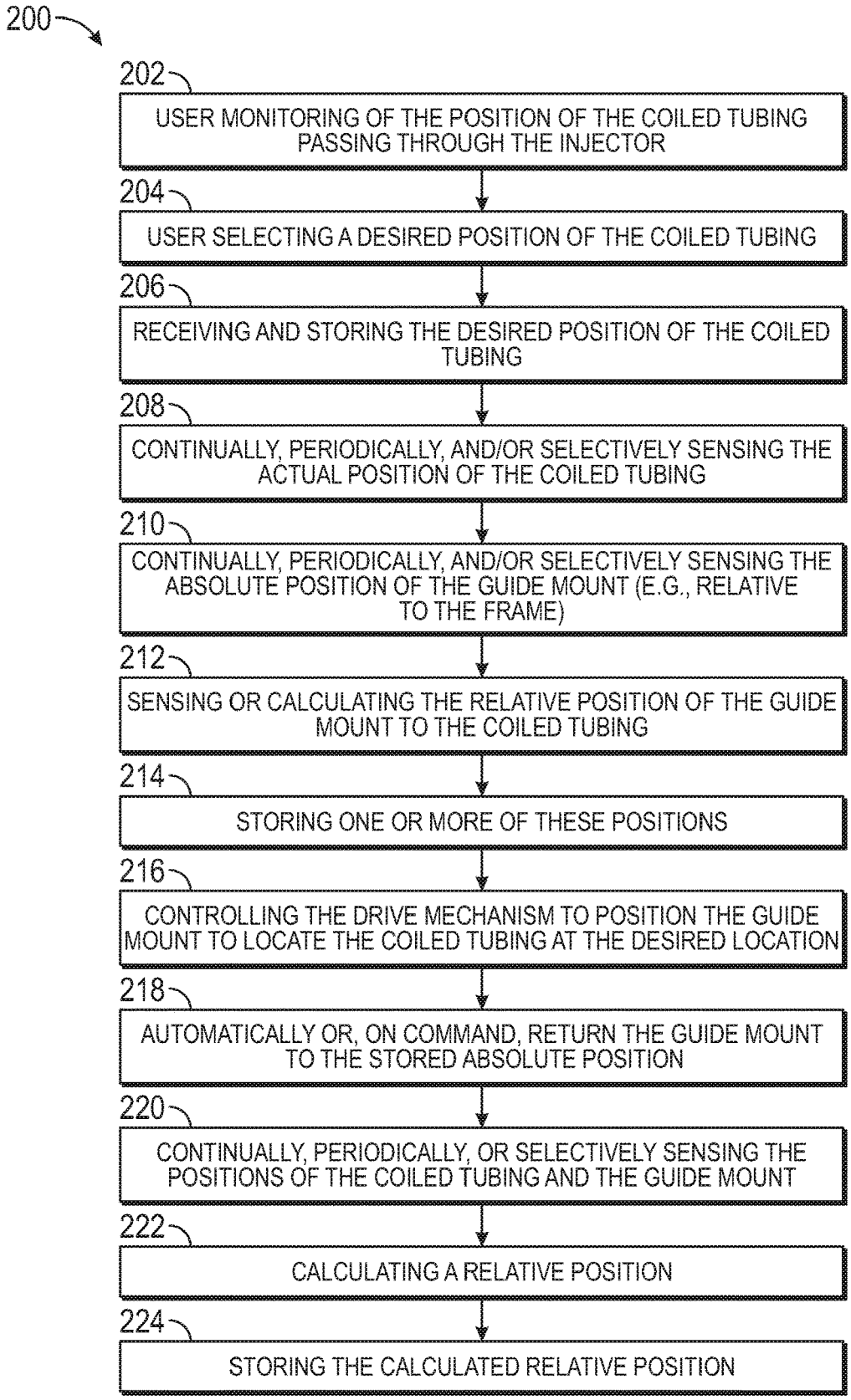
FIG. 36 is a diagram of a method of use, according one or more embodiments.

In operation and use, and as shown in FIG. 36, a method of operation 200 may be provided. A user may monitor the position of the coiled tubing passing through the injector 202 and may select a desired position of the coiled tubing 204. The system may store the desired position of the coiled tubing 206. The system may also continually, periodically, and/or selectively sense the actual position of the coiled tubing 208. The system may also sense the absolute position of the guide mount (e.g., relative to the frame) 210 and may also sense and/or calculate the relative position of the guide mount to the coiled tubing 212. The system may store one or more of these positions 214. With the stored actual and desired position of the coiled tubing and the stored absolute and relative positions of the guide mount, the controller may be adapted to position the guide mount to locate the coiled tubing at the desired location 216. In one or more embodiments, where the guide mount is moved, the controller may be adapted to automatically or, on command, return the guide mount to the stored absolute position 218. In one or more embodiments, and over time, the relative position of the guide mount to the coiled tubing may change as systems wear, for example. The system may continually, periodically, or selectively sense the positions of the coiled tubing and the guide mount 220 and calculate a relative position 222. Where the value of the relative position changes, a new relative position may be stored 224 for use in properly positioning the guide mount and, thus, the coiled tubing.

Figure 13:
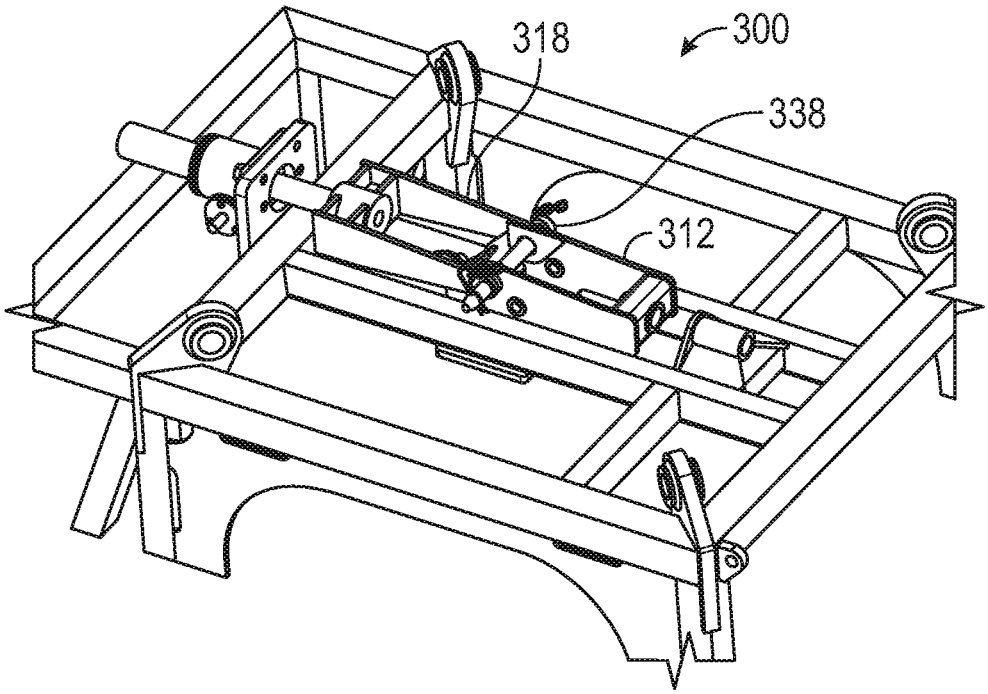
FIG. 13 is a perspective view of a remotely adjustable guide mount, according to one or more embodiments.
Figure 14:
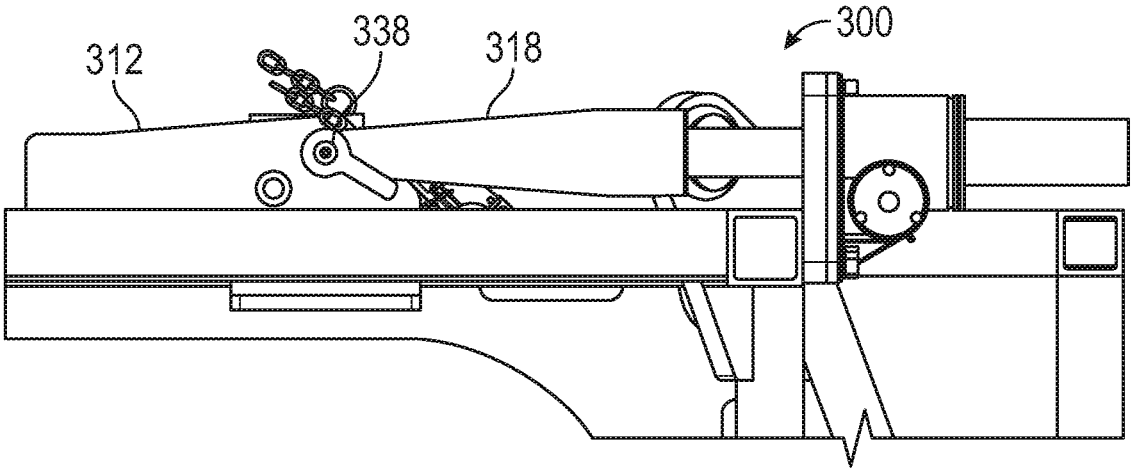
FIG. 14 is a side view thereof.
Figure 15:
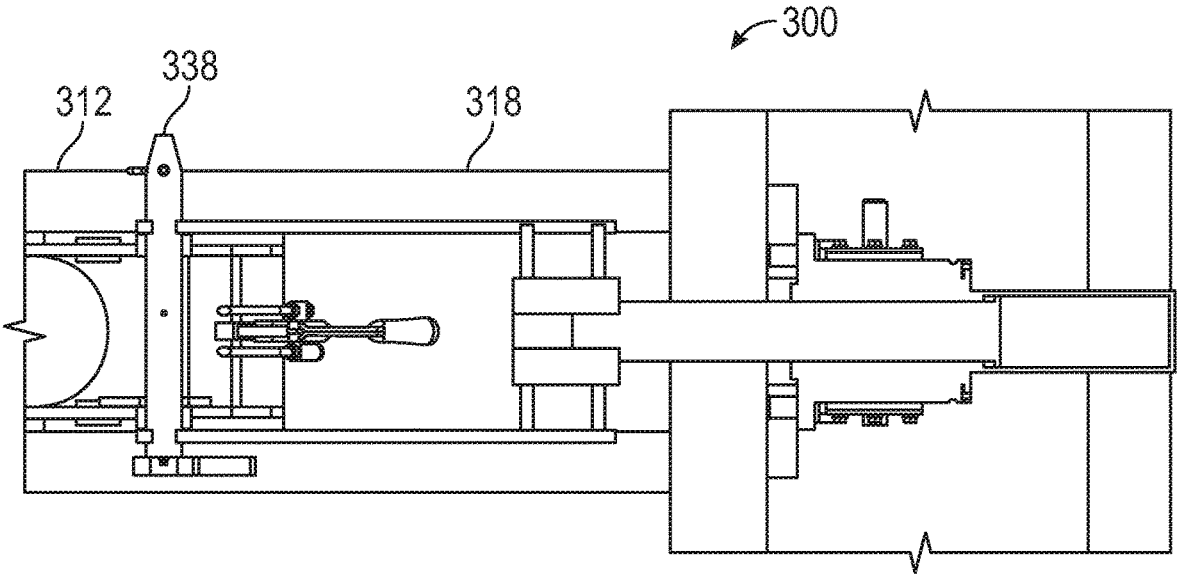
FIG. 15 is a top view thereof.

Referring now to FIGS. 13-15, another remotely adjustable guide mechanism 300 is shown. Several similarities exist between this embodiment and the previous embodiment. However, in this embodiment, the interfacing bracket 318 may be secured to the guide mount 312 with a single securing pin 338 extending through each of the struts and two locations on the guide mount. Moreover, in this embodiment, the securing pin may include a single pin that secures the guide frame to the guide mount and the interfacing bracket may be secured to the guide mount with the single pin.

Figure 16:
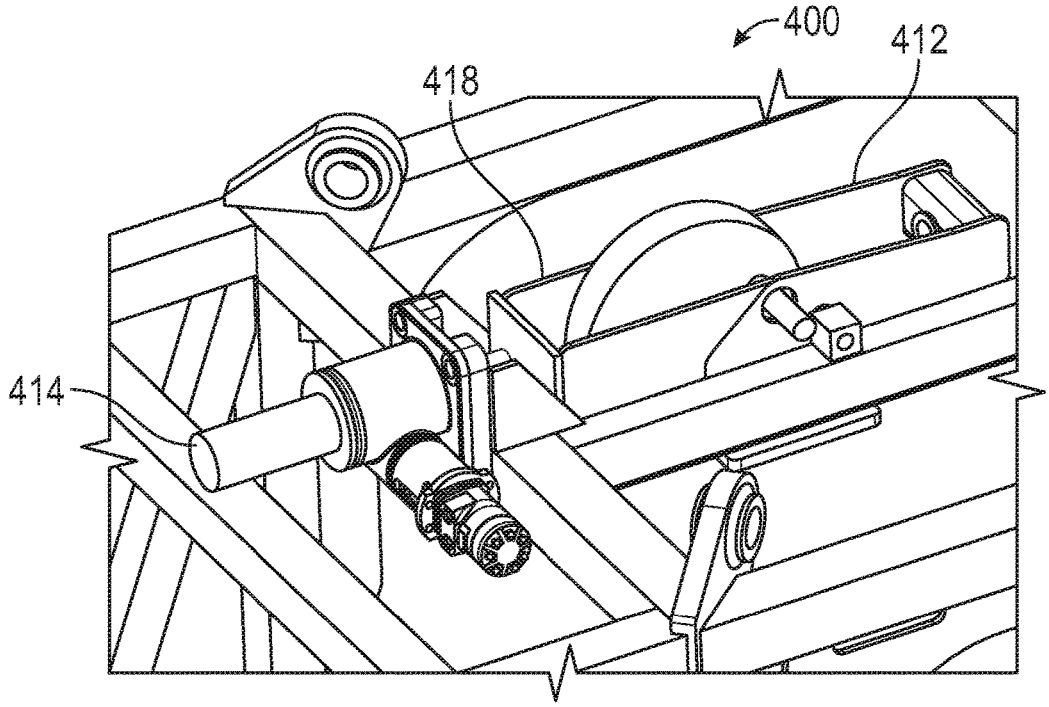
FIG. 16 is a perspective view of a remotely adjustable guide mount, according to one or more embodiments.
Figure 17:
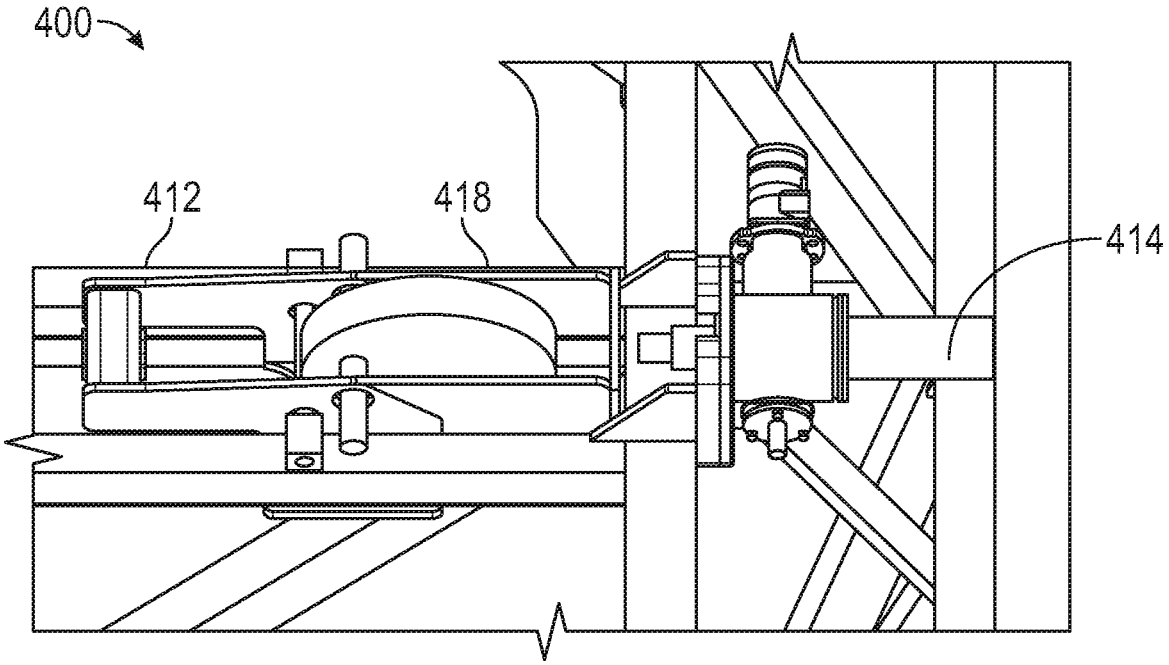
FIG. 17 is an additional perspective view thereof.
Figure 18:
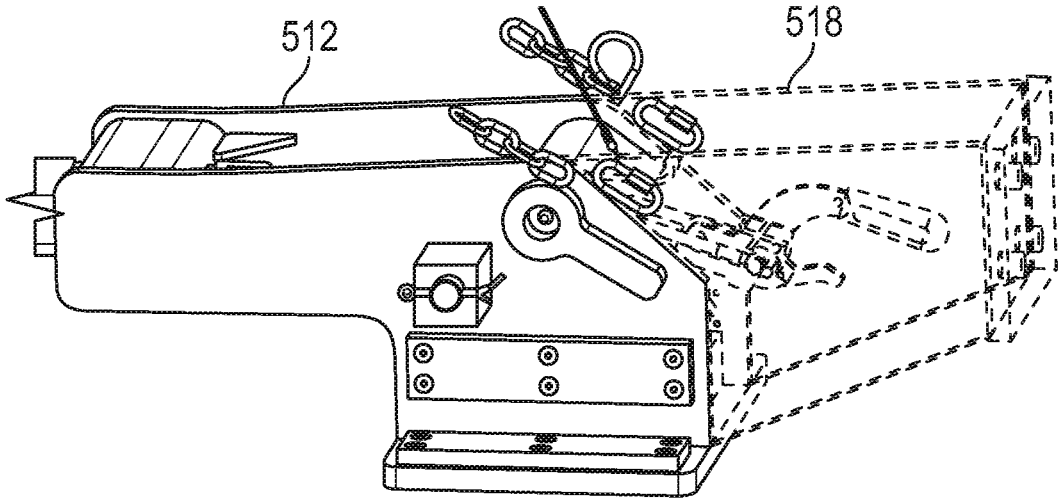
FIG. 18 is a perspective view of another remotely adjustable guide mount, according to one or more embodiments.
Figure 19:
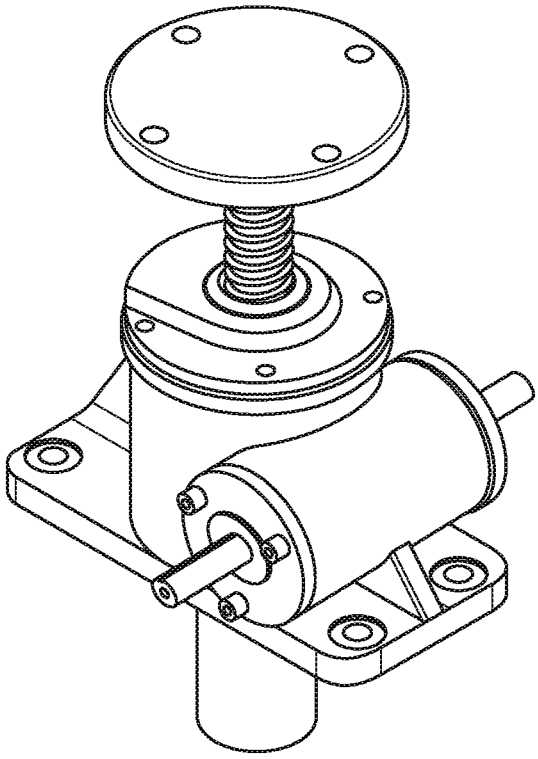
FIG. 19 is a perspective view of a worm screw option for a remotely adjustable guide mount, according to one or more embodiments.

FIGS. 16-17 include another remotely adjustable guide mechanism 400 for a tubing guide. As may be appreciated, this system is mounted on the front side of the guide mount 412 and includes an interfacing bracket 418 that involves extending the lateral sidewalls of the guide mount 412. As shown, the drive mechanism 414 may include a motorized drive such as a worm gear drive or other drive system. It is to be appreciated, that the circular element within the guide mount in these figures is showing the path of travel of the stabilization mechanism and is not intended to show a particular element of the design.

Figure 20:
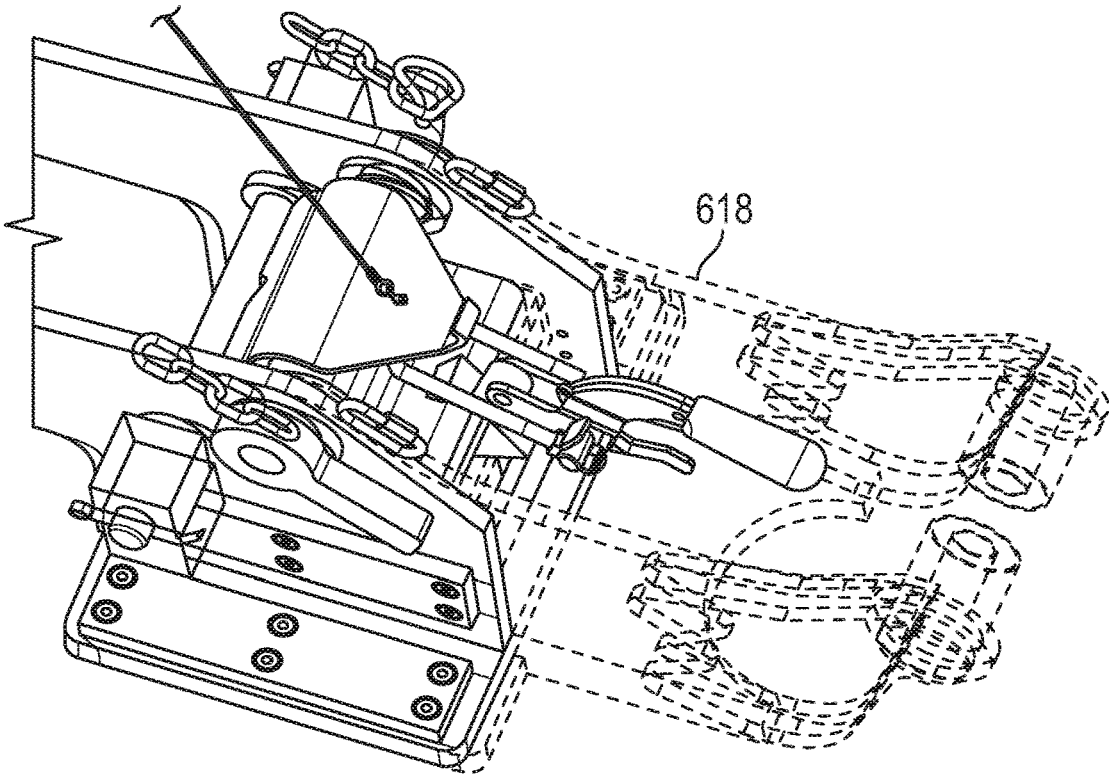
FIG. 20 is a perspective view of a remotely adjustable guide mount, according to one or more embodiments.
Figure 21A:
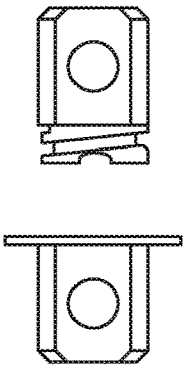
FIG. 21A is an exploded view of a clevis, according to one or more embodiments.
Figure 21B:
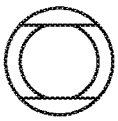
FIG. 21B is atop view thereof.
Figure 22:
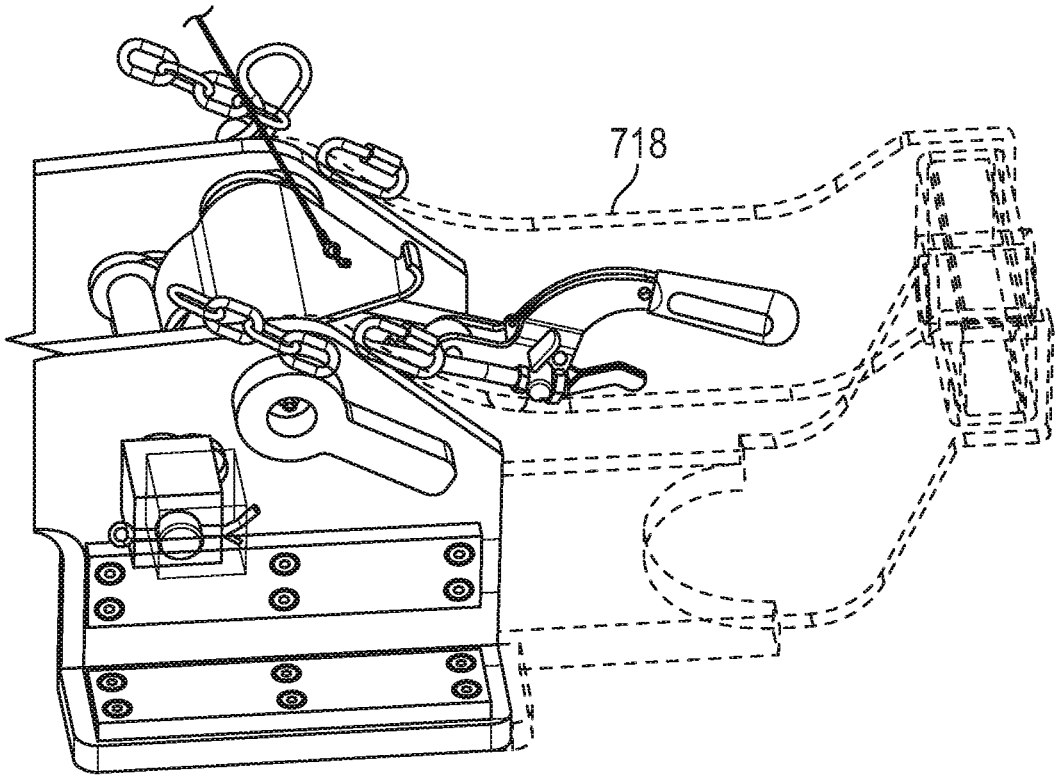
FIG. 22 is a perspective view depicting another option for a remotely adjustable guide mount, according to one or more embodiments.
Figure 23:
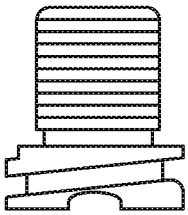
FIG. 23 is aside view of a portion of a clevis mechanism, according to one or more embodiments.
Figure 24:
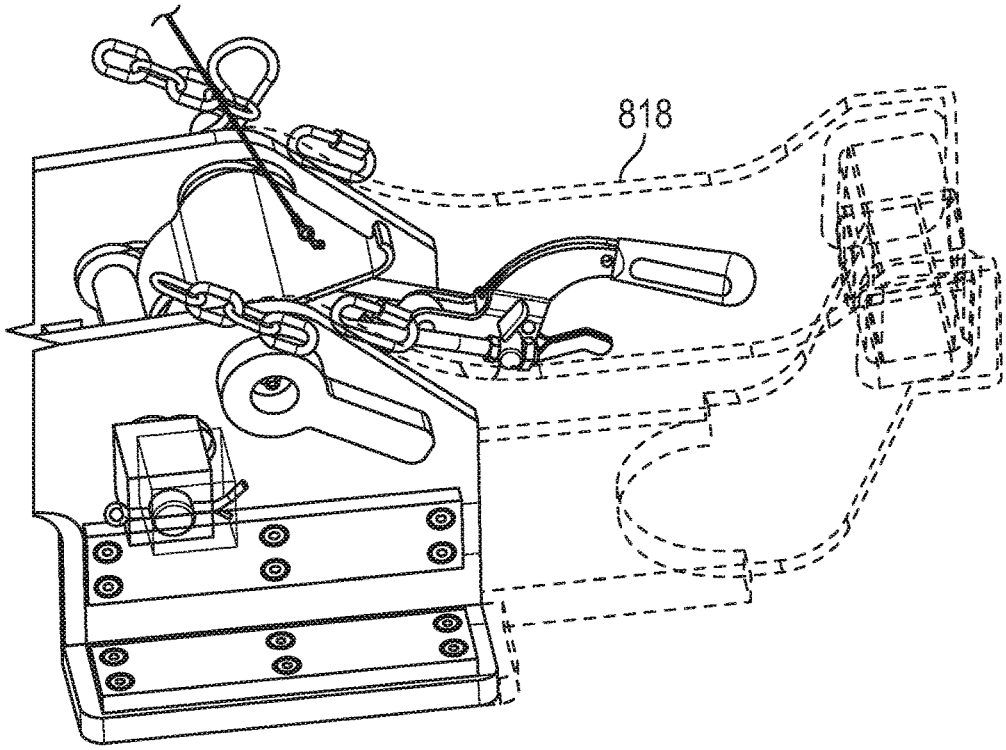
FIG. 24 is a perspective view of another option for a remotely adjustable guide mount, according to one or more embodiments.
Figure 25:
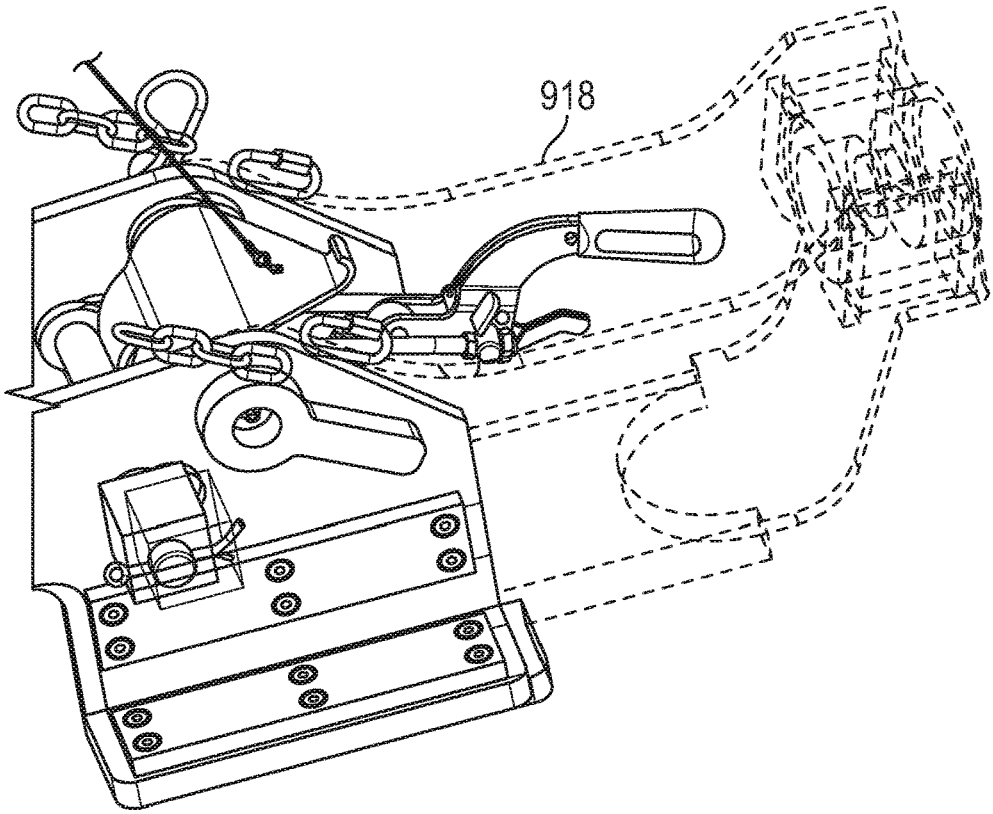
FIG. 25 is a perspective view of another option for a remotely adjustable guide mount, according to one or more embodiments.

FIGS. 18-25 include additional options and or details relating to extending the tubing guide mount and adapting it for engagement with a drive mechanism on a front side of the guide mount. In one or more embodiments, the interfacing bracket 518 may include a series of plates welded onto the guide mount 512 and extending in a forward direction and supporting a cross beam with a collar, for example. As with the earlier embodiment, the present series of plates and beams may be arranged to avoid interfering with the stabilization handle on the guide. The collar may be adapted to receive an articulating element of a drive mechanism to cause the guide mount 512 to articulate and allowing for alignment of the guide mount. The options shown in FIGS. 18-25 may be suitable for most any drive mechanism arranged on a front side of the guide mount 512. A similar interfacing bracket 618 is shown in FIG. 20 and another similar bracket 718 is shown in FIG. 22. Still further similar brackets 818, 918 are shown in FIGS. 24 and 25.

While a motorized worm gear has been shown as a drive mechanism and while the remotely controlled drive mechanism has been shown to be arranged on a front side of the guide mount, alternative approaches may be used. For example, the drive mechanism may be arranged on a rear side of the guide mount similar to the manual system and alterative drive mechanisms may be used.

Figure 26:
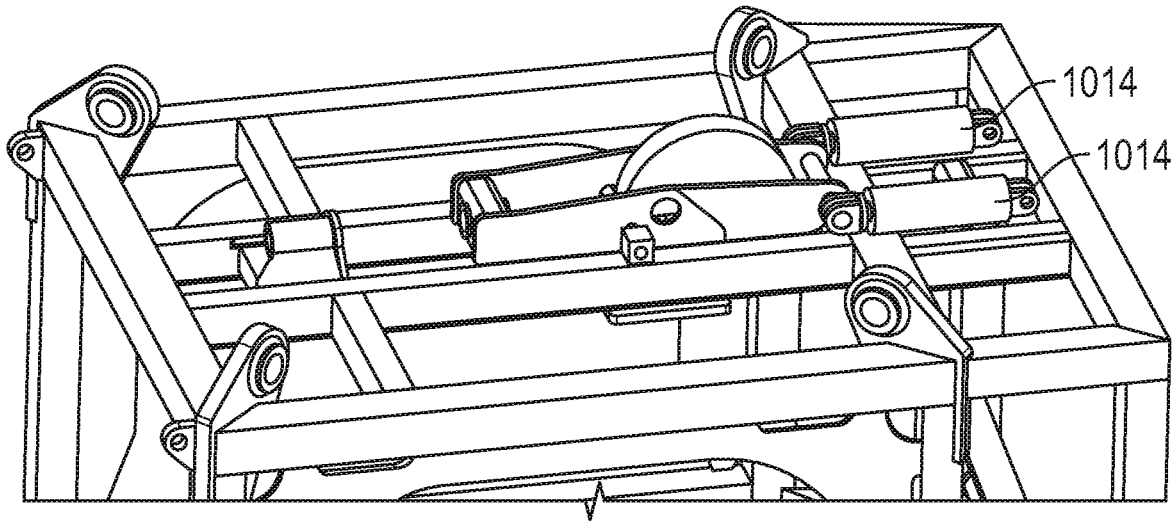
FIG. 26 includes a perspective view of still another option for a remotely adjustable guide mount, according to one or more embodiments.

One example of an alternative drive mechanism may include a hydraulic cylinder system to control the position of the guide mount. As shown in FIG. 26, the drive mechanism 1014 may include one or more hydraulic cylinders secured to the frame and to the guide mount. The cylinders may be actuated to extend or retract and adjust the position of the guide mount.

Figure 27:
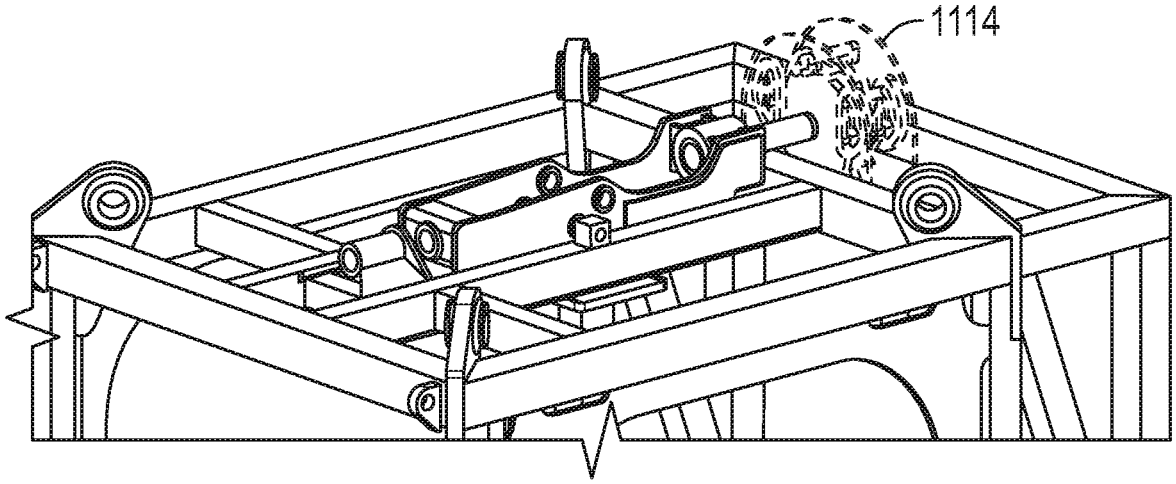
FIG. 27 includes a perspective view of still another option for a remotely adjustable guide mount, according to one or more embodiments.
Figure 28:
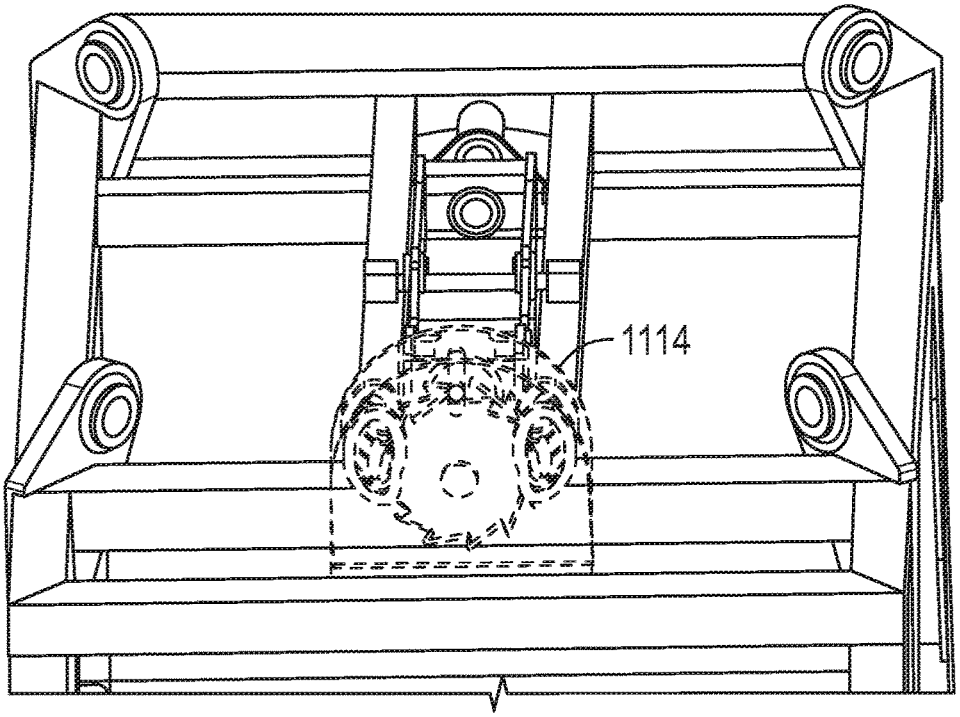
FIG. 28 is an end view thereof.

Another example of an alternative drive mechanism 1114 is shown in FIGS. 27 and 28. In this embodiment, a series of serrated saw blade type discs may be used in ratchet like fashion to rotate a shaft and control reverse motion.

Figure 29:
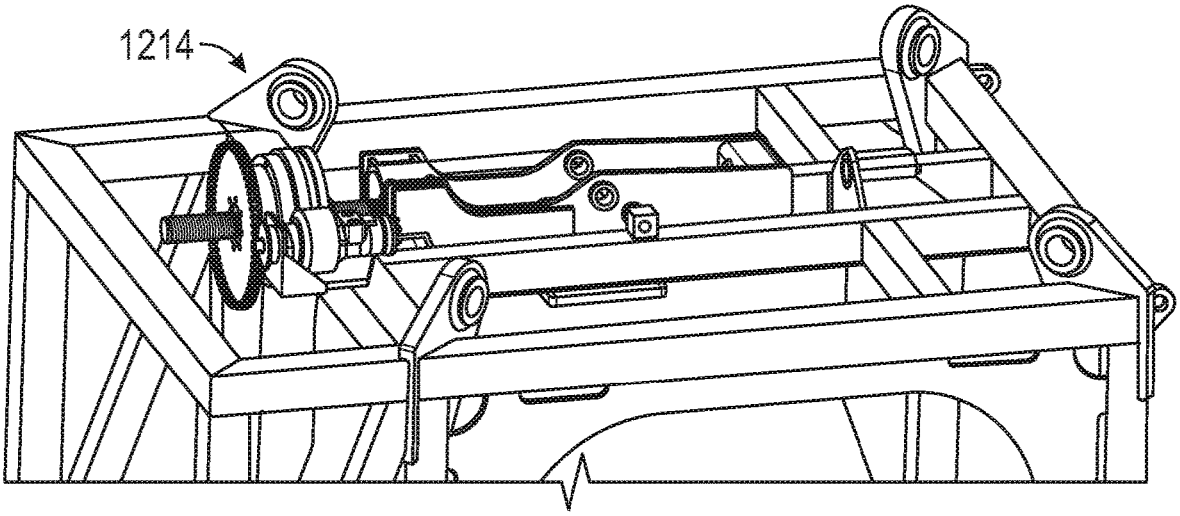
FIG. 29 includes a perspective view of still another option for a remotely adjustable guide mount, according to one or more embodiments.

In still another embodiment, as shown in FIG. 29, a gear reducing system 1214 may be used to allow for high-power and precise control over the position of the guide mount.

Figure 30:
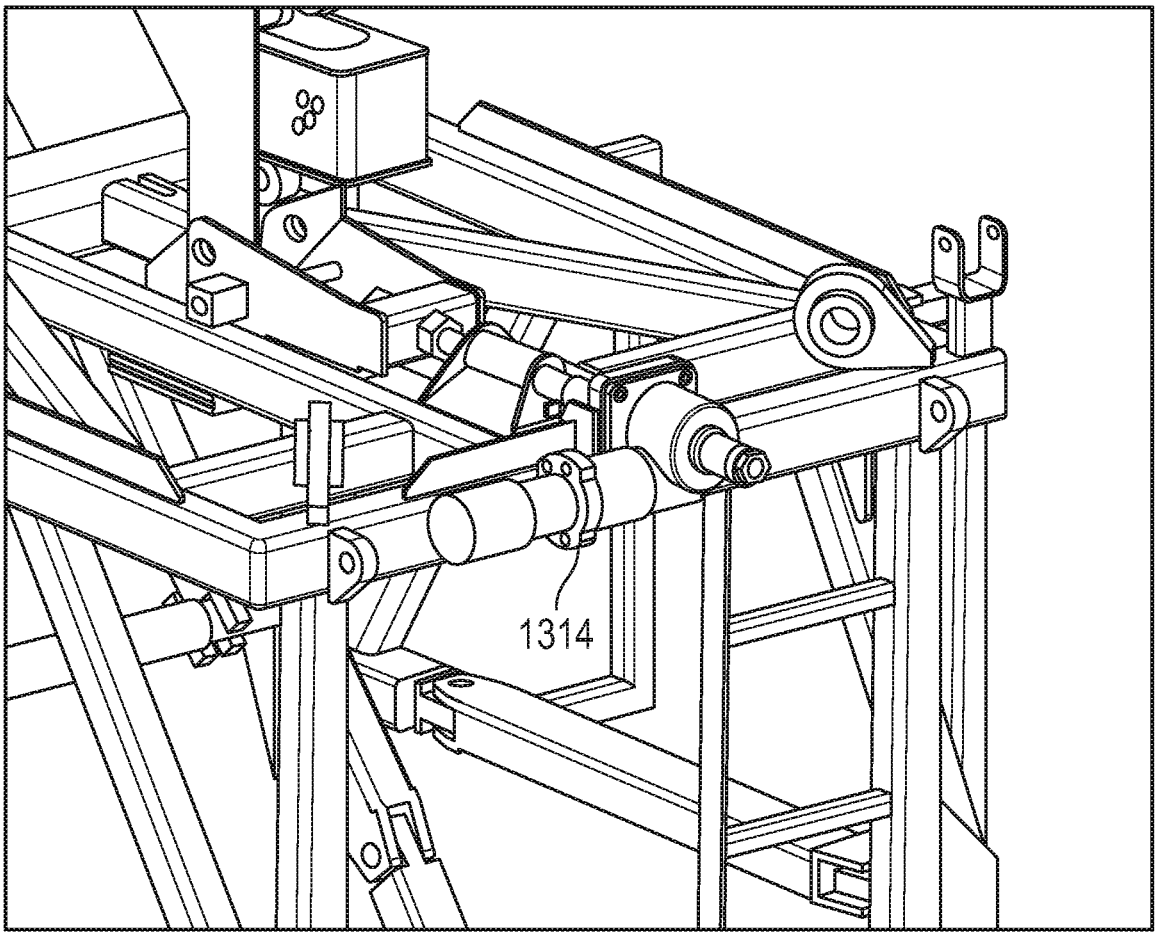
FIG. 30 includes a perspective view of still another option for a remotely adjustable guide mount with the drive mechanism on the back side of the mount, according to one or more embodiments.
Figure 31:
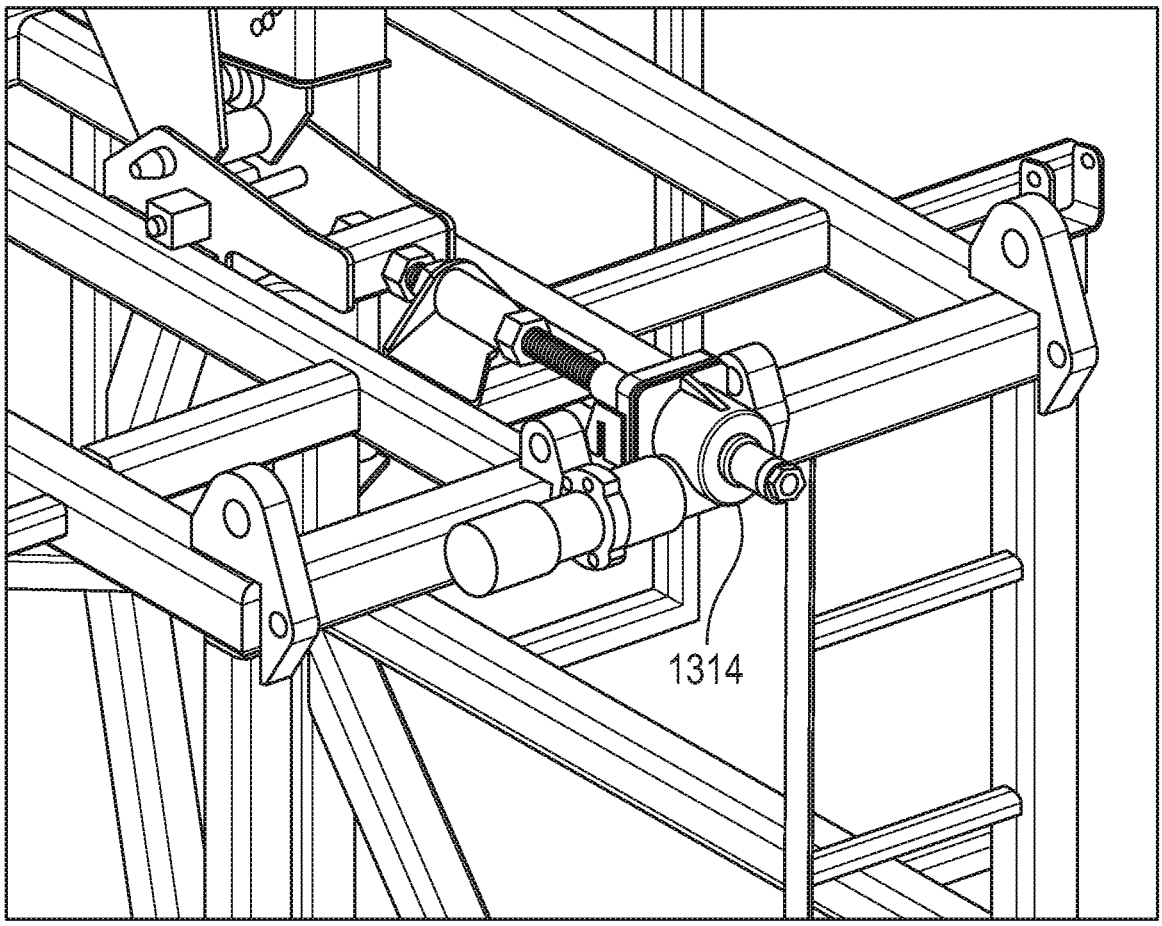
FIG. 31 includes an additional perspective view thereof.

Still another embodiment is shown in FIGS. 30-31, where a worm gear type system 1314 is shown on a rear side of the guide mount.

Figure 32B:
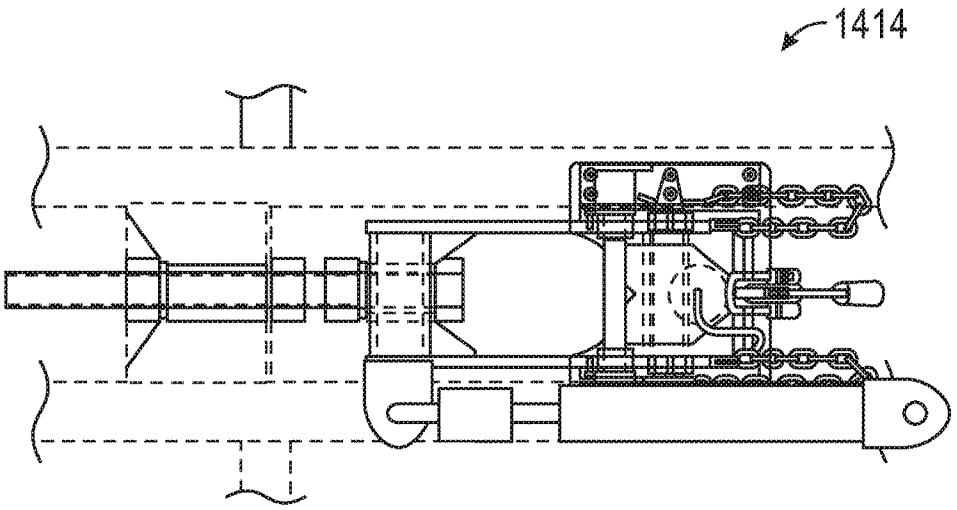
FIGS. 32A-32C include end, top, and side views, respectively, of another option for a remotely adjustable guide mount, according to one or more embodiments.
Figure 32C:
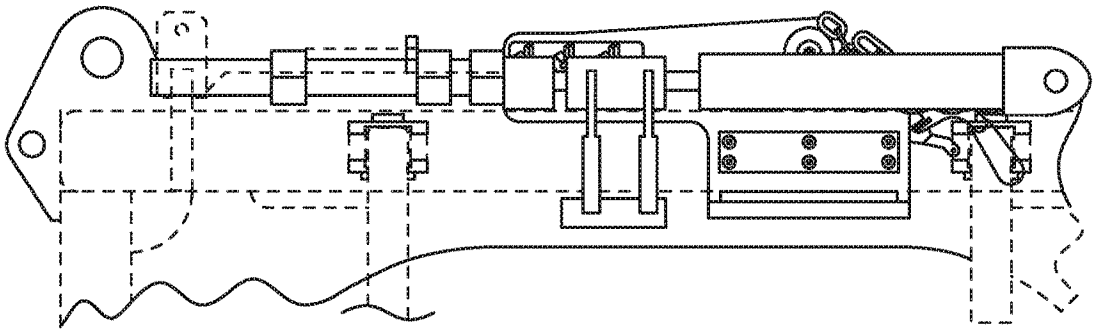
Figure 32A:
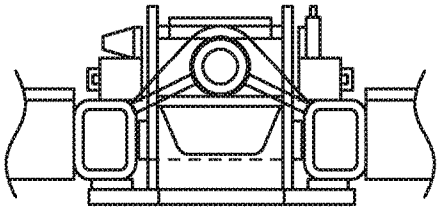

FIGS. 32A-32C shows yet another embodiment of a remotely adjustable guide mechanism 1414. In this embodiment, a hydraulic cylinder is used to adjust locking wedges that may be secured in place using one or more transversely positioned hydraulic cylinders.

Figure 33B:
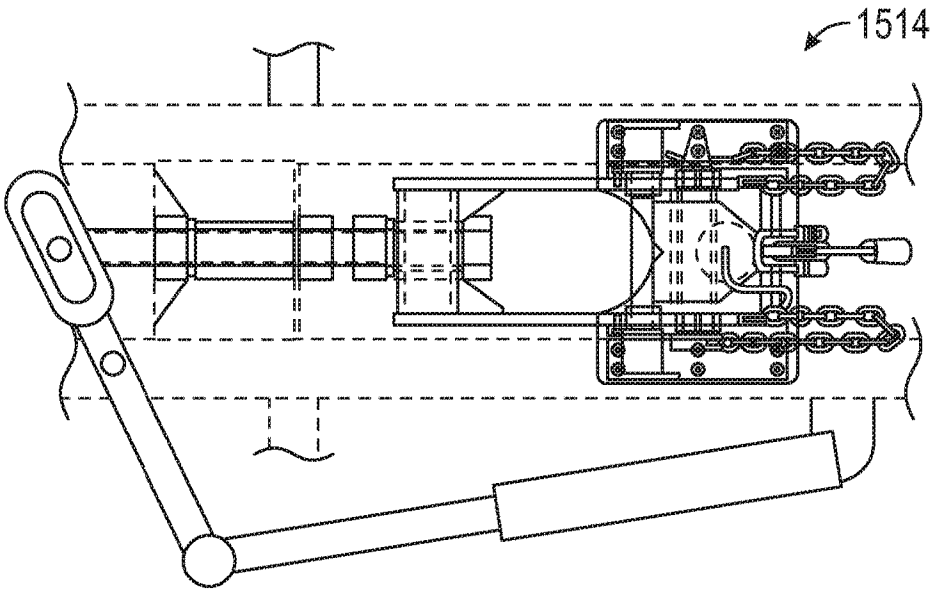
FIGS. 33A-33C include end, top, and side views, respectively, of another option for a remotely adjustable guide mount, according to one or more embodiments.
Figure 33C:
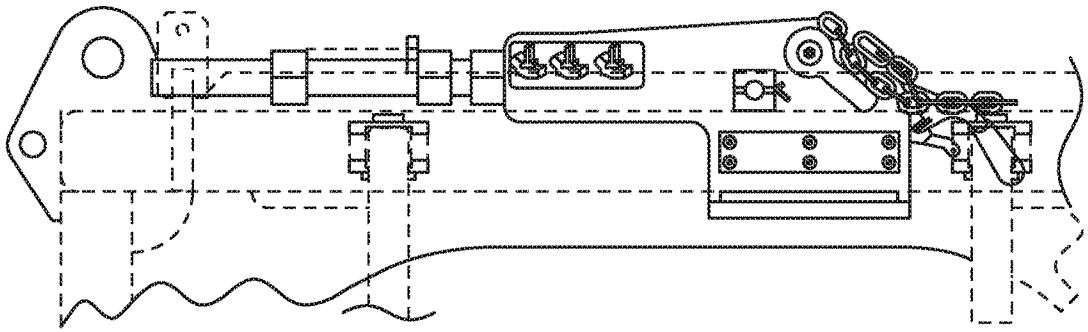
Figure 33A:
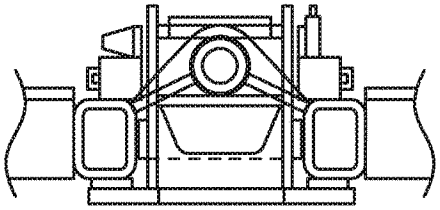

FIGS. 33A-33C shows yet another embodiment of a remotely adjustable guide mechanism 1514. In this embodiment, a hydraulic cylinder may be used to pivot a lever about a fulcrum to drive or retract the shaft and cause the guide mount to translate.

Figure 34B:
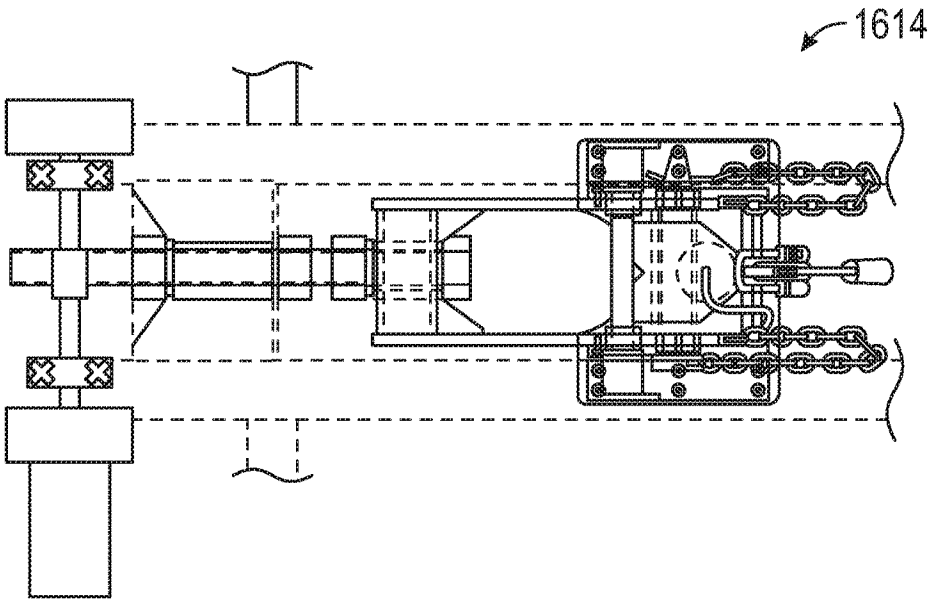
FIGS. 34A-34C include end, top, and side views, respectively of another option for a remotely adjustable guide mount, according to one or more embodiments.
Figure 34C:
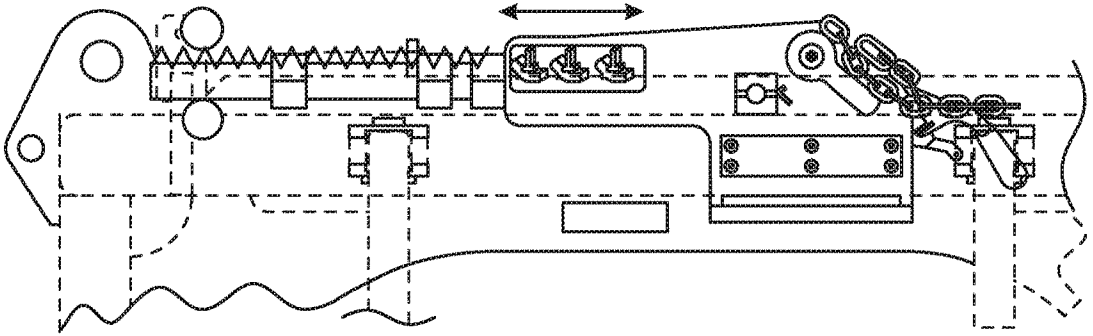
Figure 34A:
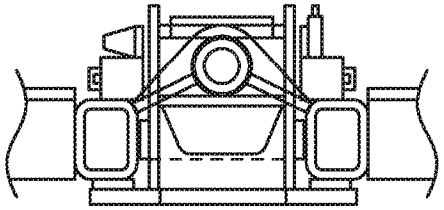

FIGS. 34A-34C shows yet another embodiment of a remotely adjustable guide mechanism 1614. In this embodiment, a rack and pinion system is used to translate the guide mount.

Still other types of drive mechanisms may be used and may be arranged on the front or rear of the guide mount.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an element may still actually contain such element as long as there is generally no significant effect thereof.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

What is claimed is:

1. A coiled tubing injector system, comprising:

a coiled tubing injector guide configured for guiding coiled tubing into a coiled tubing injector; and a remotely adjustable guide mechanism, the mechanism comprising:

a guide mount configured for adjustably securing the coiled tubing injector guide to a frame of the coiled tubing injector; and a drive mechanism configured for remotely adjusting a position of the guide mount relative to the frame, wherein the drive mechanism comprises an articulating element for controlling the motion of the guide mount.

2. The system of claim 1, further comprising an interface bracket for coupling the articulating element to the guide mount.

3. The system of claim 2, wherein the interface bracket is configured to provide clearance for a stabilization mechanism on the coiled tubing injector guide.

4. The system of claim 1, further comprising a drive mount configured for mounting of the drive mechanism and providing a stationary reference position.

5. The system of claim 1, wherein the drive mechanism comprises at least one of an electric drive mechanism, a hydraulic drive mechanism, and a pneumatic drive mechanism.

6. The system of claim 1, further comprising a visual feedback feature.

7. The system of claim 6, wherein the visual feedback feature is configured to display a coiled tubing injector guide position at an operator location.

8. The system of claim 1, further comprising a controller.

9. The system of claim 8, wherein the controller is configured to store a position of the guide mount.

10. The system of claim 9, wherein the controller is configured to control the drive mechanism to position the guide mount at the stored position.

11. The system of claim 10, wherein the controller is configured to detect and report a selected position.

12. The system of claim 11, wherein the controller is configured to adjust the guide mount to the selected position.

13. The system of claim 11, wherein the drive mechanism is in communication with the controller to actuate the drive mechanism from a remote location.

14. The system of claim 13, wherein the drive mechanism controls a side-to-side position of the guide mount.

15. The system of claim, 8, wherein the coiled tubing injector is arranged within the frame.

16. The system of claim 15, wherein the drive mechanism is in communication with the controller to actuate the drive mechanism from a remote location.

17. The system of claim 16, wherein the drive mechanism controls a side-to-side position of the guide mount.

18. The system of claim 17, wherein the drive mechanism controls the side-to-side position of the guide mount to align the coiled tubing with the coiled tubing injector.

19. The system of claim 17, wherein the controller is configured to store a position of the guide mount.

20. The system of claim 19, wherein the controller is configured to control the drive mechanism to position the guide mount at the stored position.

21. A method of adjusting a guide mount of a coiled tubing injector guide on a coiled tubing injector, the method comprising:

receiving a coiled tubing position from an operator;

sensing a position of at least one of the guide mount and coiled tubing passing through the injector; and adjusting the position of the guide mount to an aligned position to provide the coiled tubing position.

22. The method of claim 21, further comprising storing the aligned position.

23. The method of claim 22, further comprising monitoring the position of the guide mount.

24. The method of claim 23, further comprising monitoring the position of the coiled tubing passing through the injector.

25. The method of claim 24, further comprising calculating and storing a relative position of the guide mount and the coiled tubing.

26. The method of claim 25, further comprising adjusting the position of the guide mount.

27. The method of claim 26, further comprising returning the guide mount to the aligned position.

* * * * *